US006024270A

United States Patent [19]

Matlock

[11] Patent Number: 6,024,270

[45] Date of Patent: Feb. 15, 2000

[54] WOOD TIE END PLATING MACHINE

[75] Inventor: Gordon E. Matlock, Bourbon, Mo.

[73] Assignee: Robbins Mfg. Co., Tampa, Fla.

[21] Appl. No.: 09/250,051

[22] Filed: Feb. 12, 1999

Related U.S. Application Data

[62] Division of application No. 08/955,046, Oct. 21, 1997.

[51] Int. Cl.[7] ..... B27F 7/02

[52] U.S. Cl. ..... 227/152; 227/2; 227/100

[58] Field of Search ..... 227/152, 150, 227/151, 153, 2, 39, 44, 100; 269/156, 239, 902

[56] References Cited

U.S. PATENT DOCUMENTS

| | | | |
|---|---|---|---|
| 2,686,058 | 8/1954 | Zetterberg | 279/123 |
| 3,716,179 | 2/1973 | Frydenberg et al. | 227/48 |
| 4,305,538 | 12/1981 | Schulze et al. | 227/2 |
| 4,373,652 | 2/1983 | Matlock et al. | 227/100 |
| 4,504,006 | 3/1985 | Lollar, Sr. | 227/152 |
| 4,513,900 | 4/1985 | Matlock | 227/42 |
| 4,621,759 | 11/1986 | Wolf | 227/152 |
| 4,657,168 | 4/1987 | Matlock | 227/152 |
| 5,110,028 | 5/1992 | Matlock | 227/39 |
| 5,168,627 | 12/1992 | Owen | 29/897.34 |
| 5,199,625 | 4/1993 | Dewey et al. | 227/8 |
| 5,201,501 | 4/1993 | Fassier | 269/32 |
| 5,392,908 | 2/1995 | Black, Jr. | 206/321 |
| 5,634,319 | 6/1997 | Black, Jr. | 53/399 |
| 5,638,658 | 6/1997 | Black, Jr. | 53/399 |
| 5,692,664 | 12/1997 | Vettoretti et al. | 227/10 |
| 5,806,187 | 9/1998 | Ducret | 30/92 |

OTHER PUBLICATIONS

Tee–Lok Corporation "Color–Coded Banded Pack", Brochure, 1995.

Tee–Lok Corporation "20 Pack Plates", Brochure, 1994.

*Primary Examiner*—Scott A. Smith

*Attorney, Agent, or Firm*—Zarley, McKee, Thomte, Voorhees & Sease; Dennis L. Thomte

[57] ABSTRACT

An end plating machine for a wood tie having opposite ends comprising a frame including horizontally spaced-apart first and second end frames with the frame including tie in-feed and out-feed portions. A conveyor is provided for positioning a tie between the end frames. First and second tie clampers are positioned adjacent the first and second end frames for clamping the ends of a tie positioned therebetween. First and second power rams are mounted on the first and second end frames, respectively, for driving an end plate into the ends of the tie while the tie is being clamped by the first and second tie clampers. First and second end plate hoppers are positioned on the first and second end frames, respectively, for supporting a plurality of end plates therein. First and second end plate transporters are mounted on the first and second end frames, respectively, for successively transporting individual end plates from the hopper to a position adjacent the ends of the tie positioned in the tie clampers so that the power rams may drive the end plates into the ends of the tie.

7 Claims, 26 Drawing Sheets

WOOD TIE END PLATING MACHINE

CROSS-REFERENCE TO RELATED APPLICATION

This is a divisional application of Petitioner's earlier application Ser. No. 08/955,046 filed Oct. 21, 1997, entitled A WOOD TIE END PLATING MACHINE.

BACKGROUND OF THE INVENTION

1. Field of the Invention

This invention relates to an end plating machine for a wood tie and more particularly to a machine for end plating a wood tie wherein the opposite ends of the tie are simultaneously end plated in an automatic fashion without the need of the end plates being initially hand-tacked onto the ends of the tie.

2. Description of the Related Art

Cross ties and switch ties for use in the railroad industry are normally formed from green wood and frequently develop splits in the ends thereof during the seasoning process. It has been found desirable and necessary to close the splits or cracks in the ends of the tie and to maintain the same in that condition by means of nail plates, dowels, S-irons, etc., to extend the useful life of the tie. Many prior art devices have been provided for squeezing or clamping the ends of a tie together and then driving a nail plate or end plate into the ends thereof. For example, see U.S. Pat. Nos. 4,513,900 and 4,657,168. In the prior art end plating machines, the ties are fed into the end plating machine with the end plates being initially partially hand-tacked onto the ends of the tie to maintain the end plates in position until the ends of the tie have been squeezed or clamped and the power ram has driven the end plates into the ends of the tie. The requirement that the end plates be initially partially hand-tacked onto the ends of the tie adds additional time and labor to the end plating process.

SUMMARY OF THE INVENTION

Figure 1:
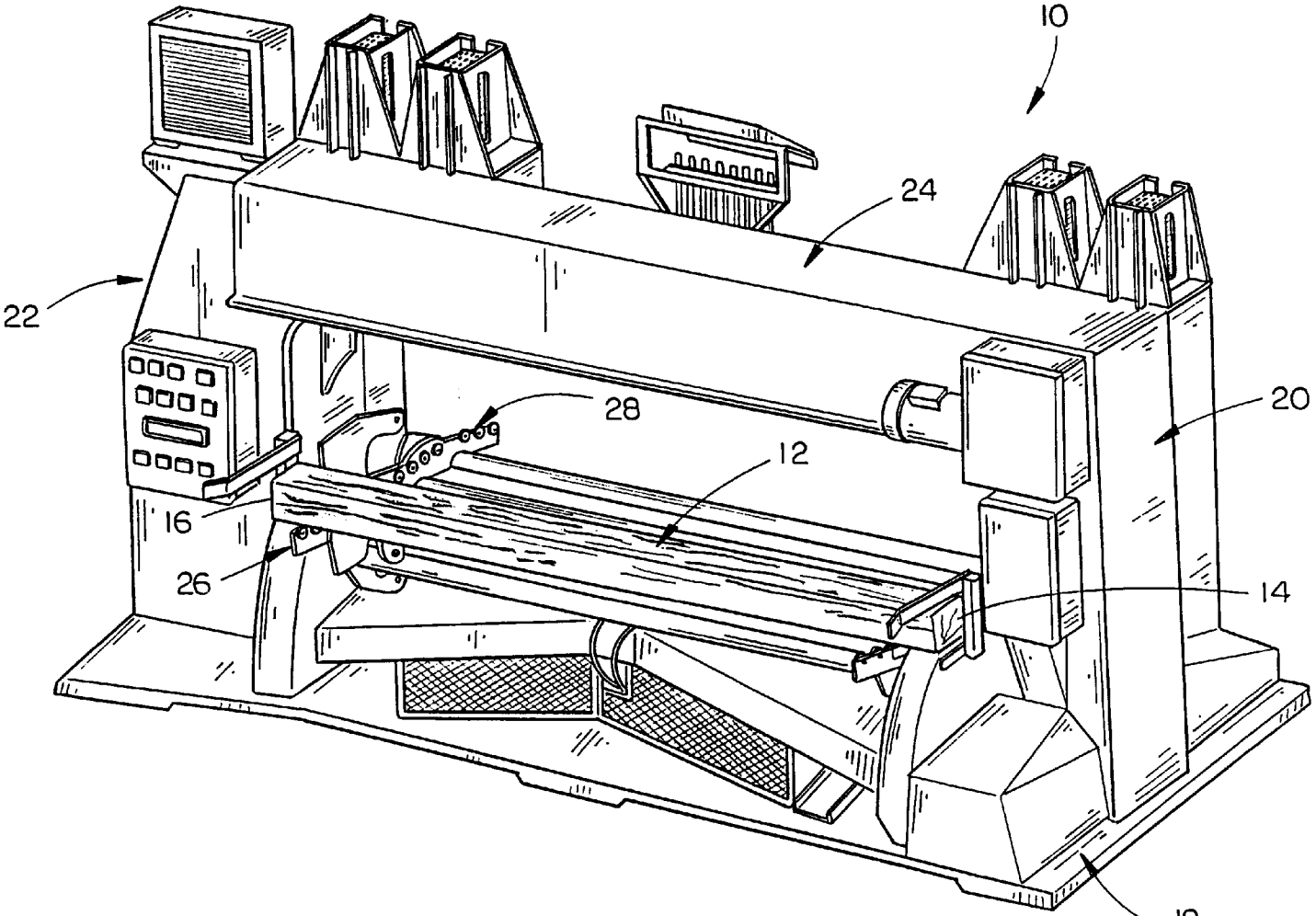
FIG. 1 is a perspective view of the end plating machine of this invention as viewed from the in-feed side thereof.

An end plating machine for a wood tie comprising a frame including horizontally spaced-apart first and second end frames with the frame having tie in-feed and out-feed portions. A first tie clamper or squeezer is provided adjacent one of the end frames for clamping or squeezing one end of the tie positioned between the end frames. A second tie clamper or squeezer is positioned adjacent the second end frame for clamping or squeezing the other end of the tie positioned between the end frames. A first power ram is mounted on the first end frame for driving an end plate into one end of the tie while the first tie clamper is clamping the end of the tie positioned therein. A second power ram is mounted on the second end frame for driving an end plate into the other end of the tie while the second tie clamper is clamping the other end of the tie positioned therein. A first end plate hopper means is mounted on the first end frame for supporting a plurality of end plates therein in a stacked condition. A second end plate hopper means is mounted on the second end frame for supporting a plurality of end plates therein in a stacked. condition. Each of the first and second hopper means have horizontally spaced hoppers for receiving end plates of different dimensions. A horizontally movable shuttle plate is movably mounted beneath each of the first and second hopper means for moving a selected end plate to a position between the spaced-apart hoppers thereof. First and second plate transporters are mounted on the first and second end frames, respectively, for successively transporting individual end plates from the respective shuttle plate to a position adjacent one end of the tie so that the power rams may drive the end plates into the ends of the tie. The machine includes means for sensing ties of different dimensions and for selectively supplying the properly dimensioned end plate to the tie.

It is therefore a principle object of the invention to provide an improved end plating machine for a wood tie.

Yet another object of the invention is to provide an end plating machine which eliminates the need for hand-tacking end plates to the ends of the tie.

Yet another object of the invention is to provide an end plating machine for a wood tie which senses different sizes of ties and which automatically supplies a properly dimensioned end plate to the power rams for insertion into the ends of the tie.

Still another object of the invention is to provide an end plating machine for a wood tie including at least one end plate hopper on horizontally spaced apart end frames.

Still another object of the invention is to provide an end plating machine for a wood tie which includes means for separating end plates which are stacked one upon the other in end plate hoppers.

Yet another object of the invention is to provide a means for bundling stacked end plates for insertion into the end plating machine.

These and other objects will be obvious to those skilled in the art.

DESCRIPTION OF THE PREFERRED EMBODIMENT

The end plating machine of this invention is referred to generally by the reference number 10 while the reference number 12 refers to an elongated wood tie which is to be end plated. For purposes of discussion, tie 12 will be described as having opposite ends 14 and 16. Generally speaking, machine 10 includes a frame means 18 including end frames 20 and 22 which have a supporting structure 24 extending therebetween. The numeral 26 designates an in-feed conveyor for positioning the tie 12, and successive ties, between the end frames 20 and 22 in a manner such as disclosed in U.S. Pat. No. 4,513,900. Machine 10 is also provided with an out-feed conveyor 28 for rotating the end plated tie out of the machine 10 and for conveying the tie away from the machine.

Figure 6A:
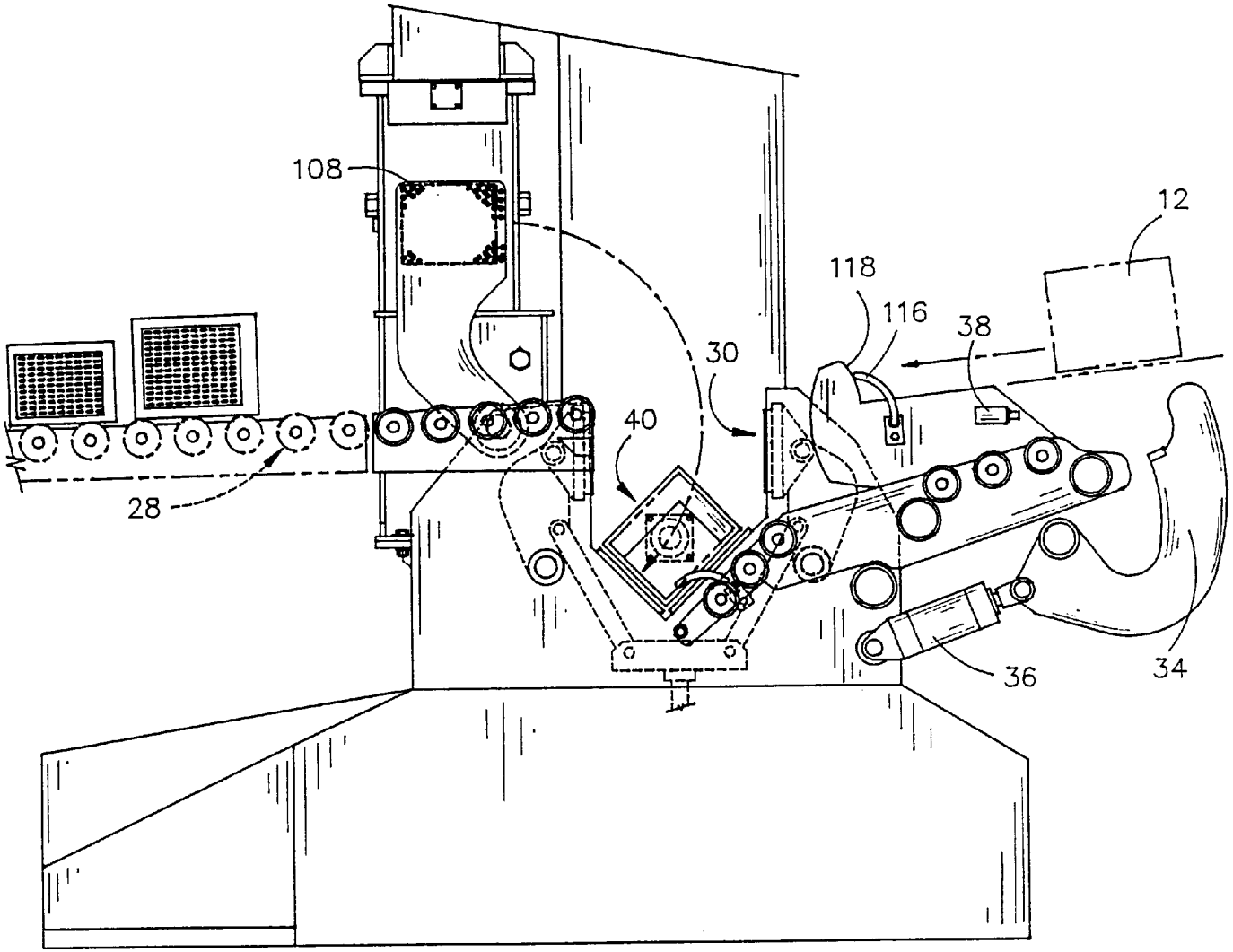
FIG. 6A is a partial side elevational view illustrating a tie being brought into position prior to it being squeezed and prior to the transporter arm bringing an end plate into position for insertion into the end of the tie.

Machine 10 further includes a tie squeezing or clamping apparatus 30 adjacent the inner end of end frame 20 and a tie squeezing or clamping apparatus 32 adjacent the inner end of end frame 22 for squeezing or clamping the opposite ends of the tie 12 to close splits or cracks in the tie prior to the end plating operation. The tie clamping apparatuses 30 and 32 are preferably constructed similar to that disclosed in U.S. Pat. Nos. 4,513,900 or 4,657,168. As seen in FIG. 6C, machine 10 also includes a pivotal tie sensing arm 34 which is pivoted by cylinder 36 and which is adapted to engage the rearward end of the tie 12 to sense the thickness of the tie 12, through microswitch 38. If a tie 12 larger than that shown in FIG. 6C is introduced into the machine, arm 34 will be prevented from activating microswitch 38 due to the thicker tie preventing movement of sensing arm 34 towards microswitch 38. If a thicker tie is sensed, a larger end plate will be driven into each end of that particular tie.

Inasmuch as the structure on each of the end frames 20 and 22 is substantially identical, only the structure on end frame 20 will be described in detail with "'" indicating identical structure on end frame 22. A horizontally disposed power ram 40 is mounted on end frame 20 outwardly or laterally of the end of the tie 12 when it is positioned in the tie clamping apparatus 30. Ram 40 includes a magnetic head 42 for magnetically supporting a metal end plate thereon. For purposes of description, the numeral 44 will designate the smaller end plate handled by the machine 10 for smaller ties while the numeral 46 will designate the larger end plate for larger ties. Each of the end plates 44 and 46 includes a plurality of teeth 48 extending from one side thereof which are driven into the end of the tie as will be described in greater detail hereinafter.

A plurality of end plates 44 are stacked one upon the other in a horizontally disposed manner, with the teeth 48 thereof extending upwardly therefrom, in end plate station or hopper 50 mounted on end frame 20. Similarly, a plurality of end plates 46 are positioned in end plate station or hopper 52. The lower ends of hoppers 50 and 52 are open so as to be in selective communication with openings 56 and 58, respectively, of shuttle plate 54 which is selectively horizontally movable with respect to hoppers 50 and 52 by means of hydraulic cylinder 60.

Figure 3A:
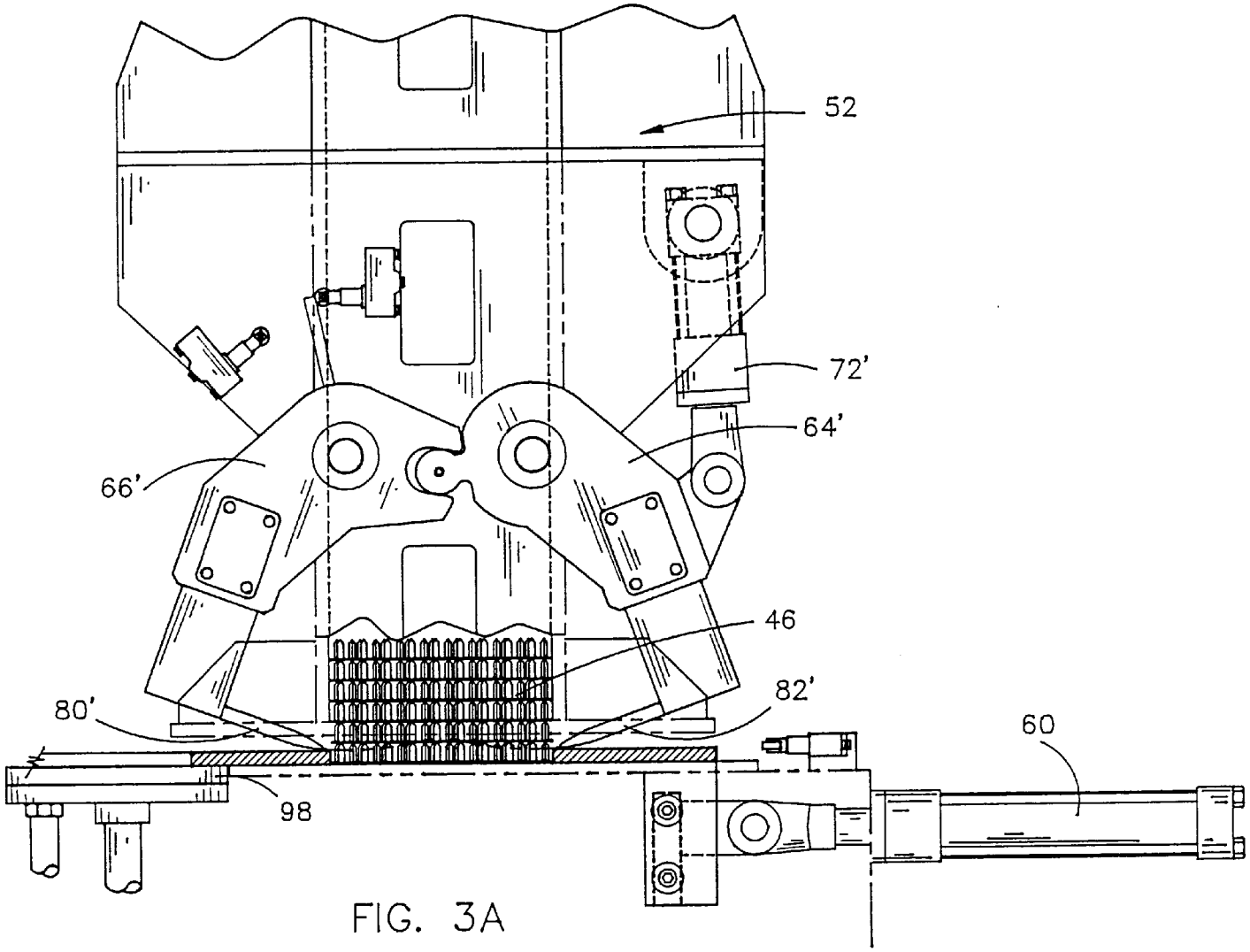
FIG. 3A is a partial end elevational view of one of the end frames illustrating one of the hopper closure means and the shuttle plate positioned there below with portions thereof cut-away to more fully illustrate the invention.
Figure 3B:
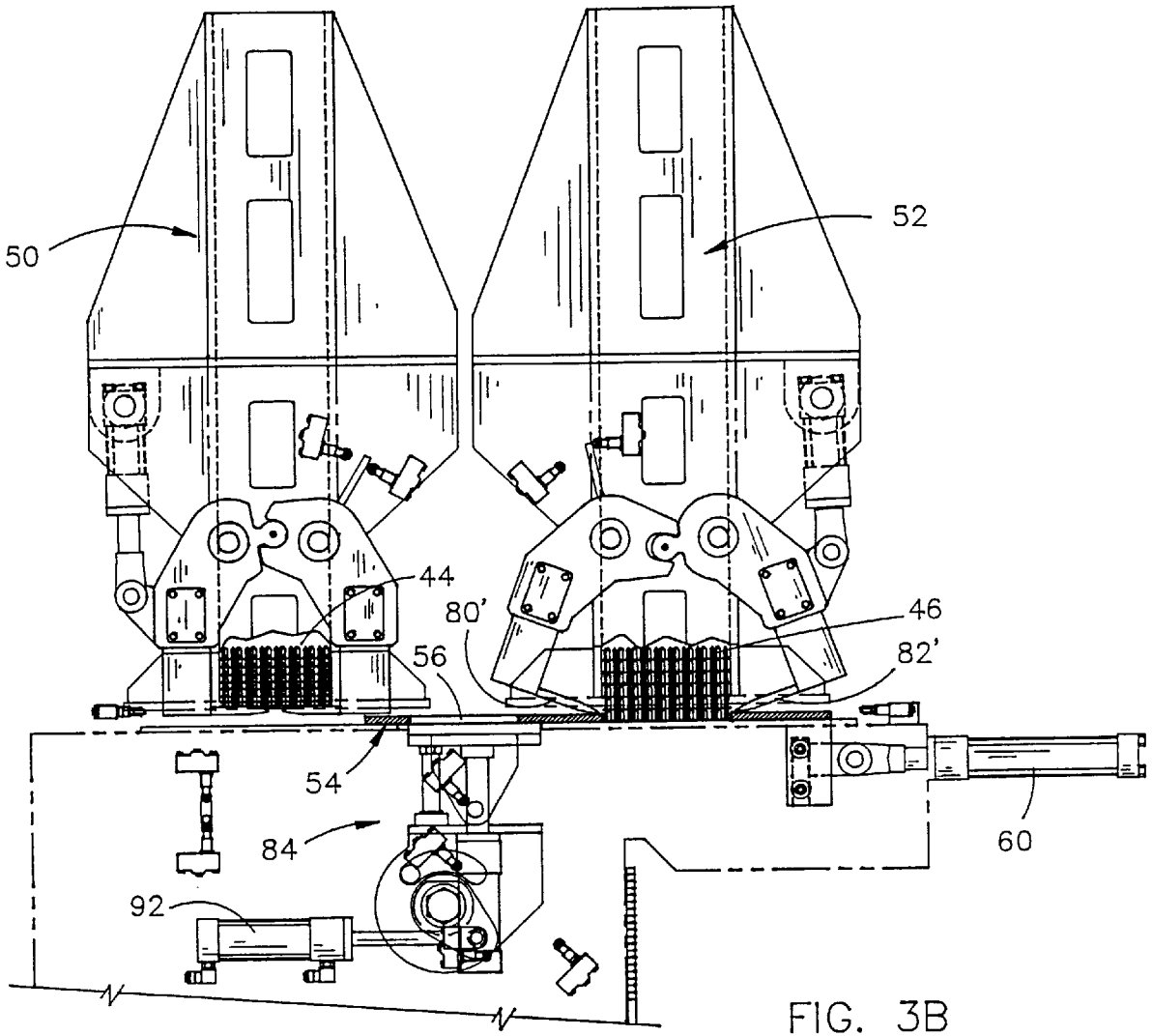
FIG. 3B is a partial end elevational view of one of the end frames of the machine with portions thereof cut-away.
Figure 3C:
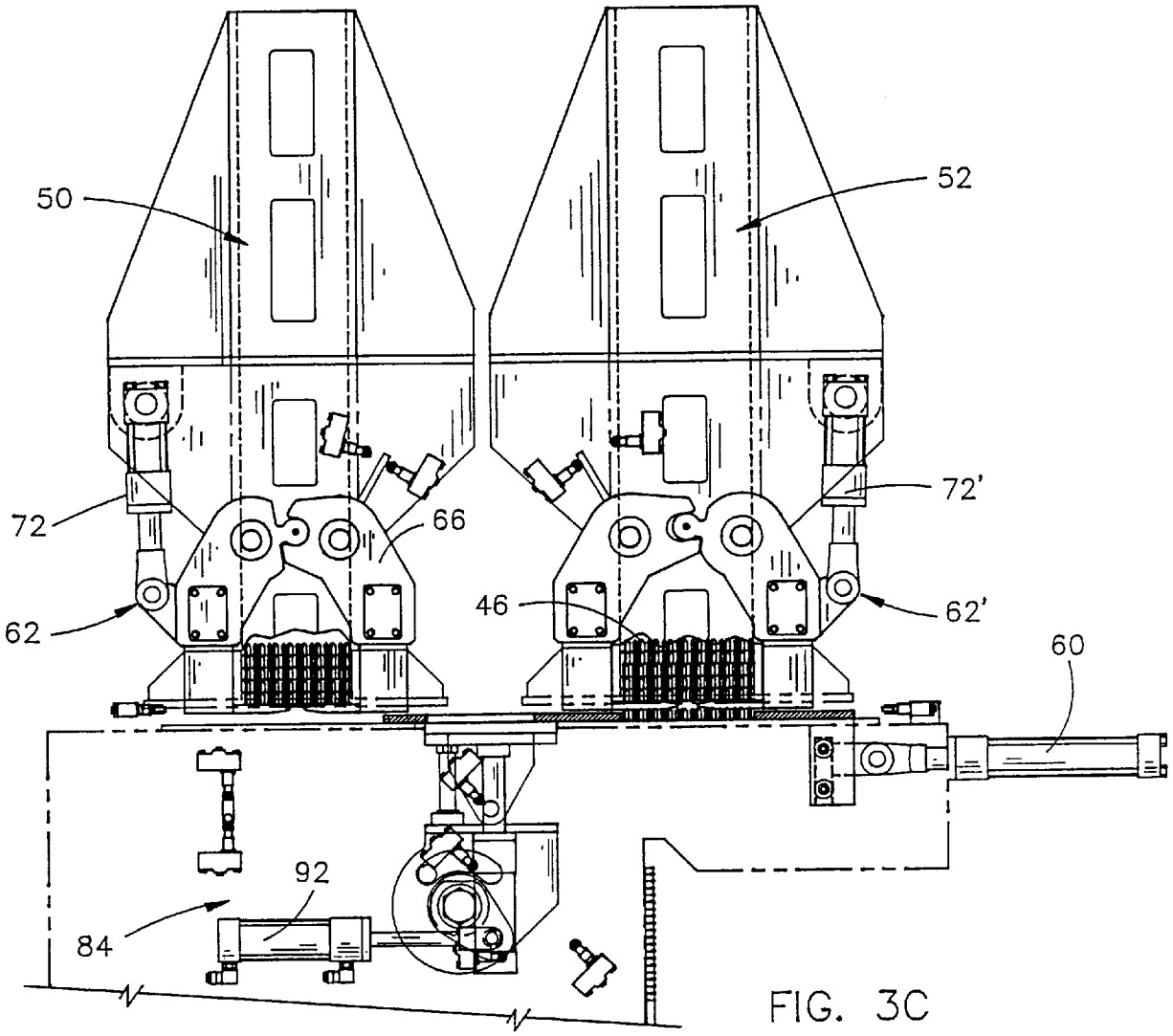
FIG. 3C is a view similar to FIG. 3B except that the hopper closure means on one of the end plate hoppers has separated the stack of end plates therein from the end plate being fed into the shuttle plate.
Figure 3D:
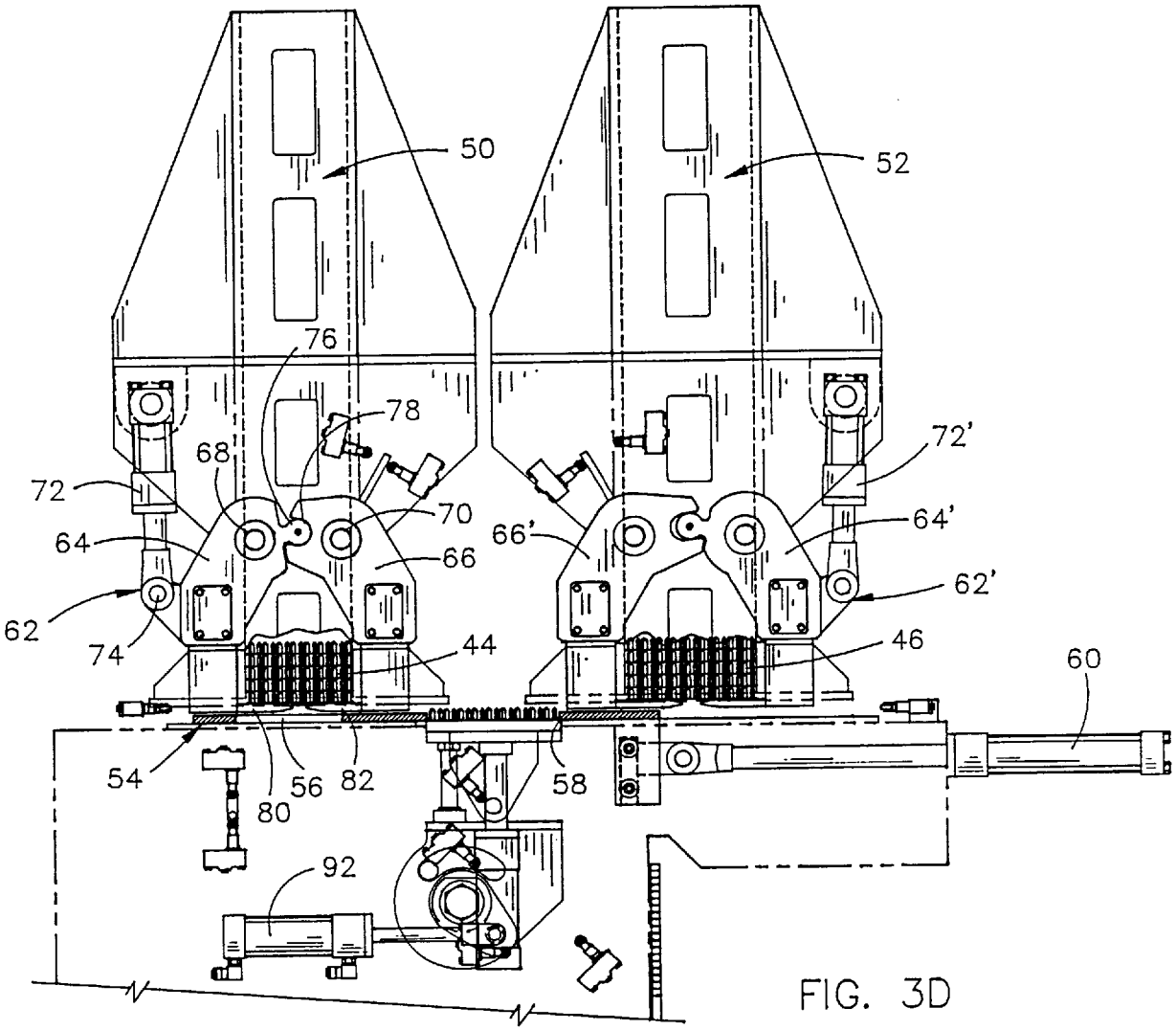
FIG. 3D is a view similar to FIG. 3C except that the shuttle plate has moved towards the left from the position of FIG. 3C so that the plate elevator may receive the end plate.

Hoppers 50 and 52 are provided with hopper closure assemblies 62 and 62' thereon, respectively, which are provided to selectively close the lower end thereof. Inasmuch as hopper closure assemblies 62 and 62' are identical, only assembly 62 will be described in detail with "'" identifying identical structure on assembly 62'. Hopper closure assembly 62 includes a pair of arms 64 and 66 which are pivoted to the supporting structure of hopper 50 at 68 and 70, respectively. Arm 64 is pivotally connected to hydraulic cylinder 72 at 74 as seen in FIG. 3D. Arm 64 is provided with a "knuckle" 76 which is movably received by opening 78 in arm 66 so that pivotal movement of arm 64 will cause pivotal movement of arm 66, as illustrated in the drawings. Arms 64 and 66 have a plurality of fingers 80 and 82 extending inwardly therefrom, respectively, which are designed to close the lower end of hopper 50 when in the position of FIG. 3D and to aid in separating the stack of end plates 44 in hopper 50 from the end plate positioned in the opening 56 of shuttle plate 54, as will be described hereinafter.

The numeral 84 refers generally to a plate elevator assembly which is positioned below the shuttle plate 54 and which includes a frame 86 pivotally mounted to end frame 20 at 88. Frame 86 includes a link arm 90 which is pivotally connected to hydraulic cylinder 92 at 94. Frame 86 has a hydraulic cylinder 96 mounted thereon which has a magnetic elevator plate 98 mounted on the end of its cylinder. When cylinder 92 is extended to the position of FIG. 4B, elevator plate 98 is positioned below shuttle plate 54. When cylinder 92 is retracted, frame 86 is pivoted from the position of FIG. 4B to the position of FIG. 4C so that hydraulic cylinder 96 is horizontally disposed and so that elevator plate 98 is positioned inwardly of opening 100 formed in end frame 50. Extension of hydraulic cylinder 96 from the position of FIG. 4C to the position of FIG. 4D causes elevator plate to move towards opening 100.

The numeral 102 refers generally to a transfer arm assembly provided on end frame 50 and which includes a transfer arm 104 mounted on shaft 106 for movement therewith. The outer end of transfer arm 104 is provided with a plate holding portion 108 which has a plurality of openings 110 formed therein adapted to receive the teeth 48 of one of the end plates 44 or 46 to support the end plate thereon. Transfer arm assembly 102 includes a hydraulic cylinder 112 for rotating transfer arm 104 from the position of FIG. 4D to the position of FIG. 5A and vice versa. Further, transfer arm assembly 102 includes a hydraulic cylinder 114 for moving transfer arm 104 outwardly from the position of FIG. 5A to the position of FIG. 5B to free the transfer arm 104 from the end plate once the end plate has been placed on the magnetic head 42 of the power ram 40 as will be explained in greater detail hereinafter.

Figure 2:
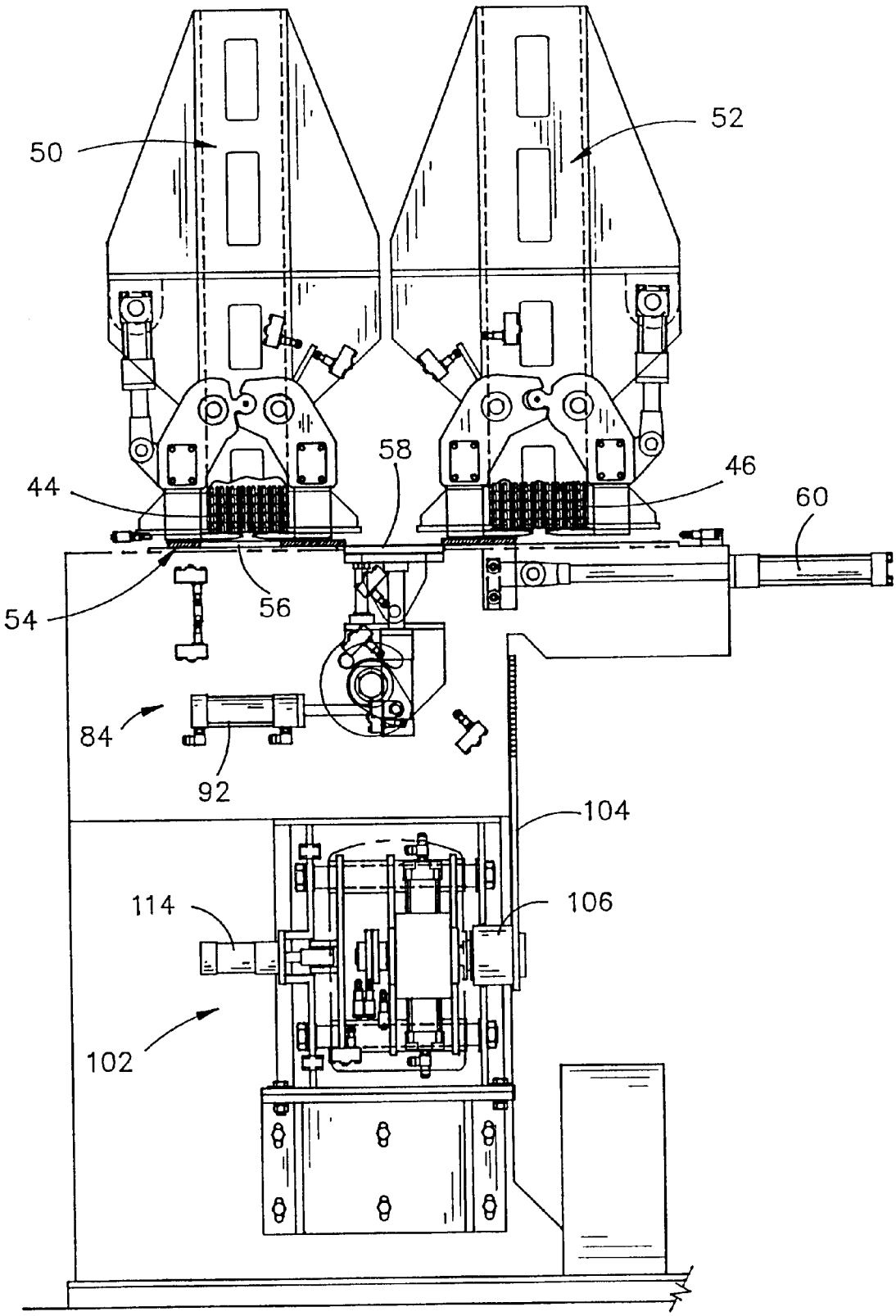
FIG. 2 is a partial vertical sectional view of one of the end frames, and associated structure, of the end plating machine.
Figure 6B:
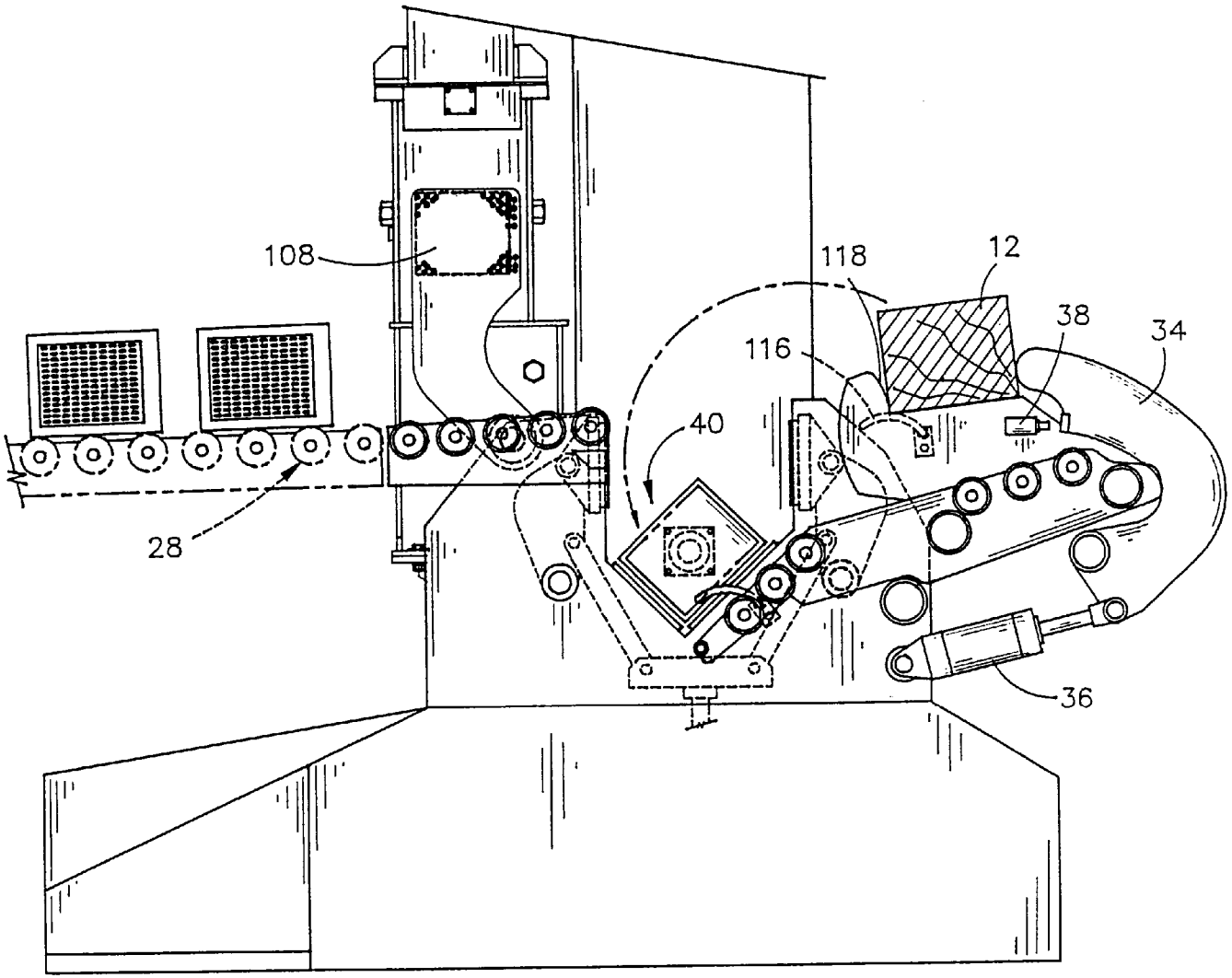
FIG. 6B is a view similar to FIG. 6A except that the tie sensing arm is illustrated as engaging an incoming tie.
Figure 6C:
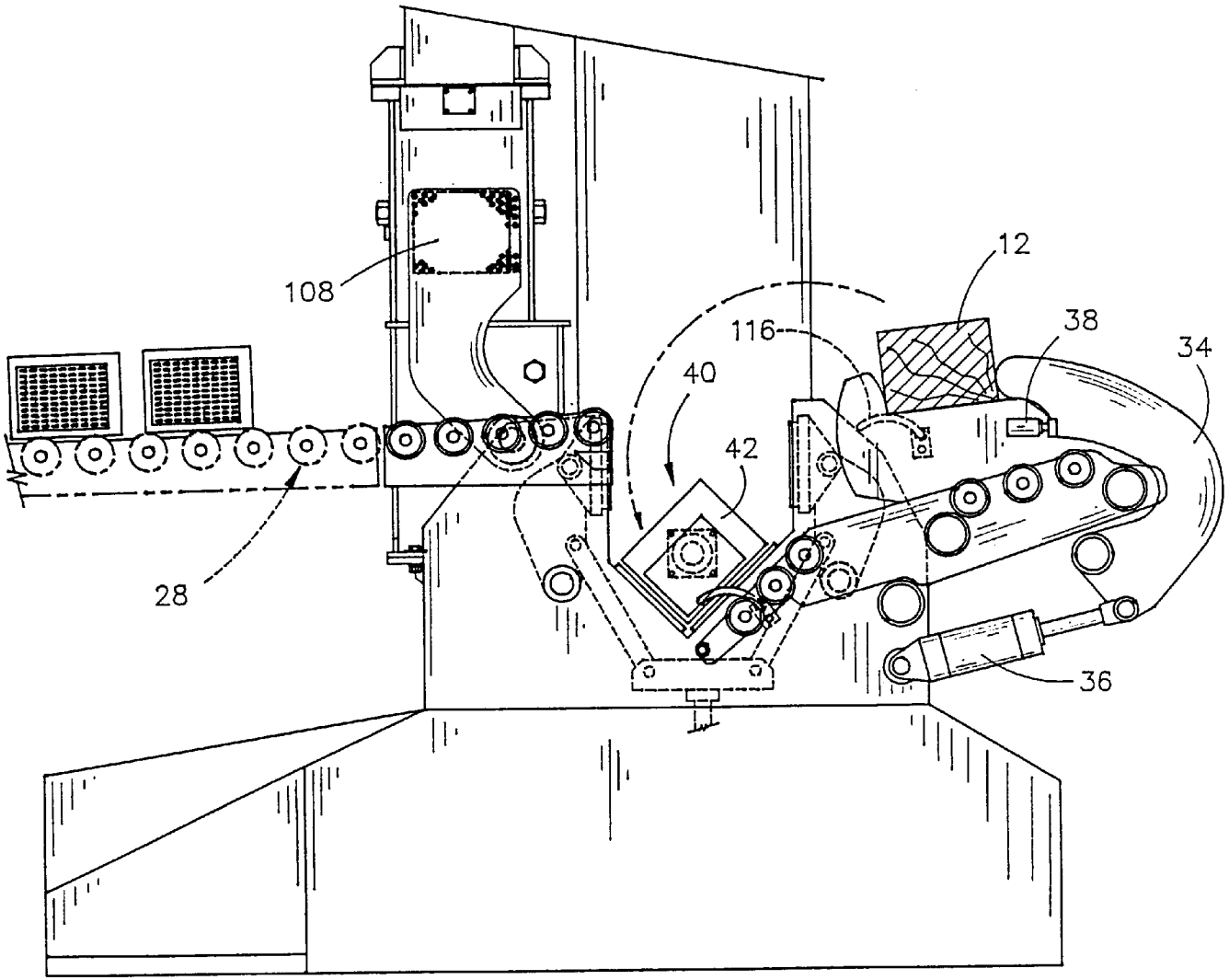
FIG. 6C is a view similar to FIG. 6B except that a smaller tie is being sensed by the sensing arm.
Figure 6D:
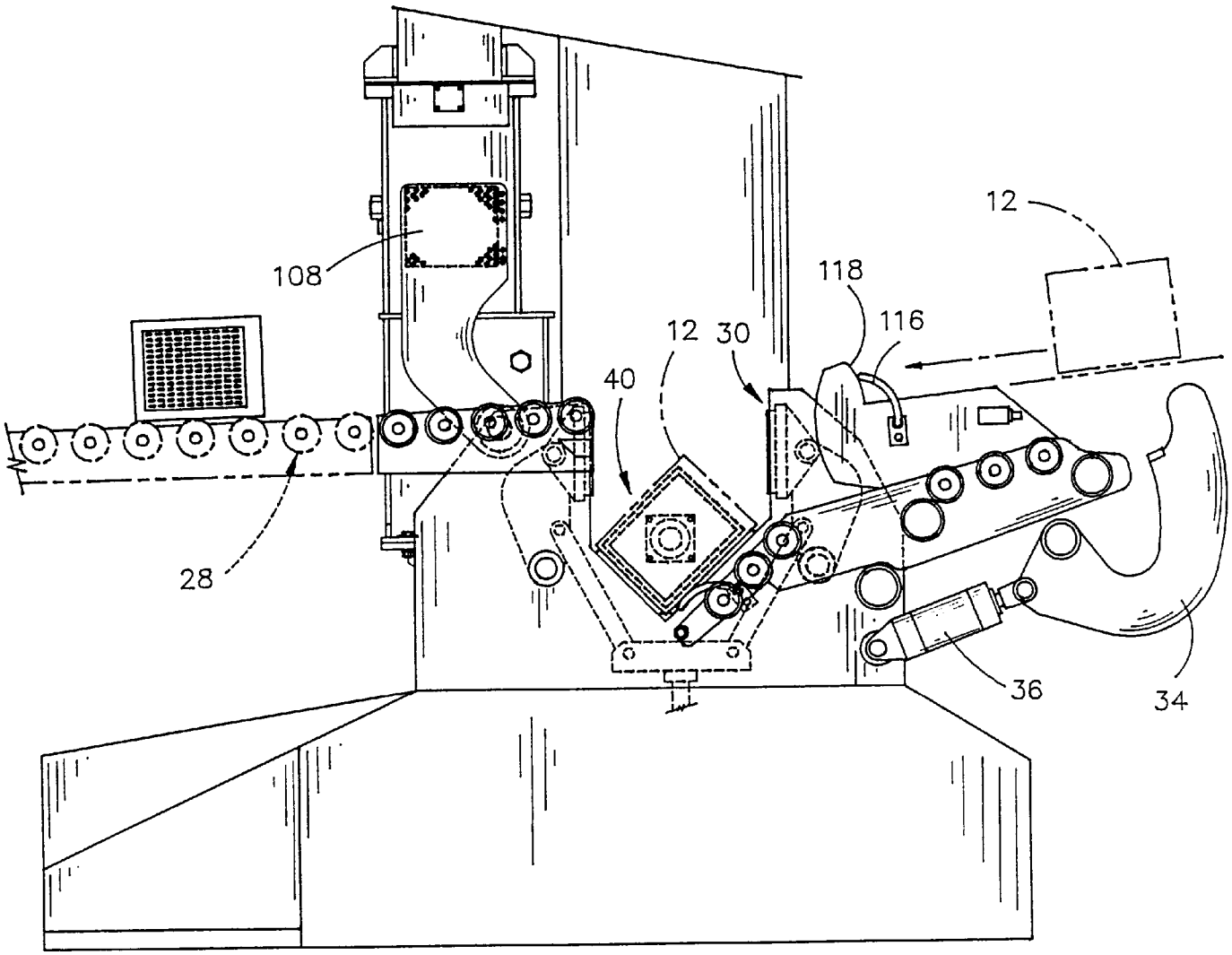
FIG. 6D is a view similar to FIG. 6B except that a larger tie is being fed into the machine.
Figure 6E:
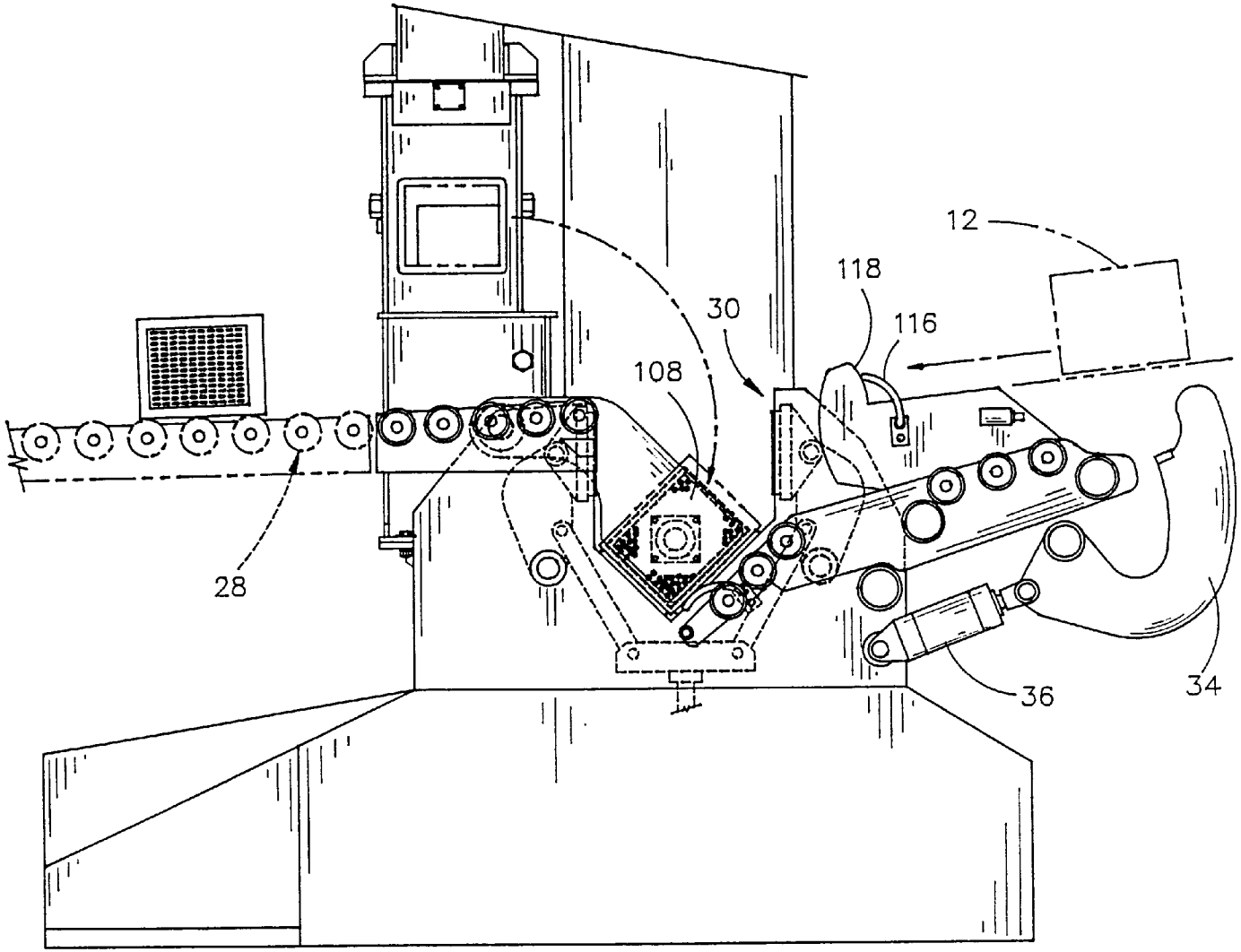
FIG. 6E is a view similar to FIG. 6D except that the transporter arm is shown as having positioned an end plate adjacent the end of the tie to be end plated.

Prior to the beginning of the end plating operation, the various components of the machine are in the position illustrated in FIGS. 2 and 6B. FIG. 6B illustrates that a tie 12 is being delivered to the plating machine following the end plating of a preceding tie 12 which is illustrated on the left hand side of FIG. 6E. The tie 12 moves forward on the in-feed conveyor 26 until incoming tie 12 engages switch 116 and comes to rest against stop 118. The tie sensing arm 34 is then pivotally moved from the position of FIG. 6A to the position of FIG. 6B until it engages the rearward side of the larger tie 12. The engagement of the forward end of the tie sensing arm 34 with the rearward end of the tie 12 prevents the tie sensing arm 34 from moving into engagement with the switch 38 which indicates to the circuitry of the machine that a larger tie is being fed into the machine. If a smaller tie such as illustrated in FIG. 6C is sensed by the tie sensing arm 34, the switch 38 is actuated so that the circuitry of the machine recognizes that a smaller tie is being fed into the machine which requires that a smaller end plate 44 such as those contained in hoppers 50 and 50' must be driven into the ends of the smaller tie. If a larger tie is being received by the machine, end plates 46 from the hoppers 52 and 52' will be transported to the ends of the tie and driven thereinto.

Figure 3E:
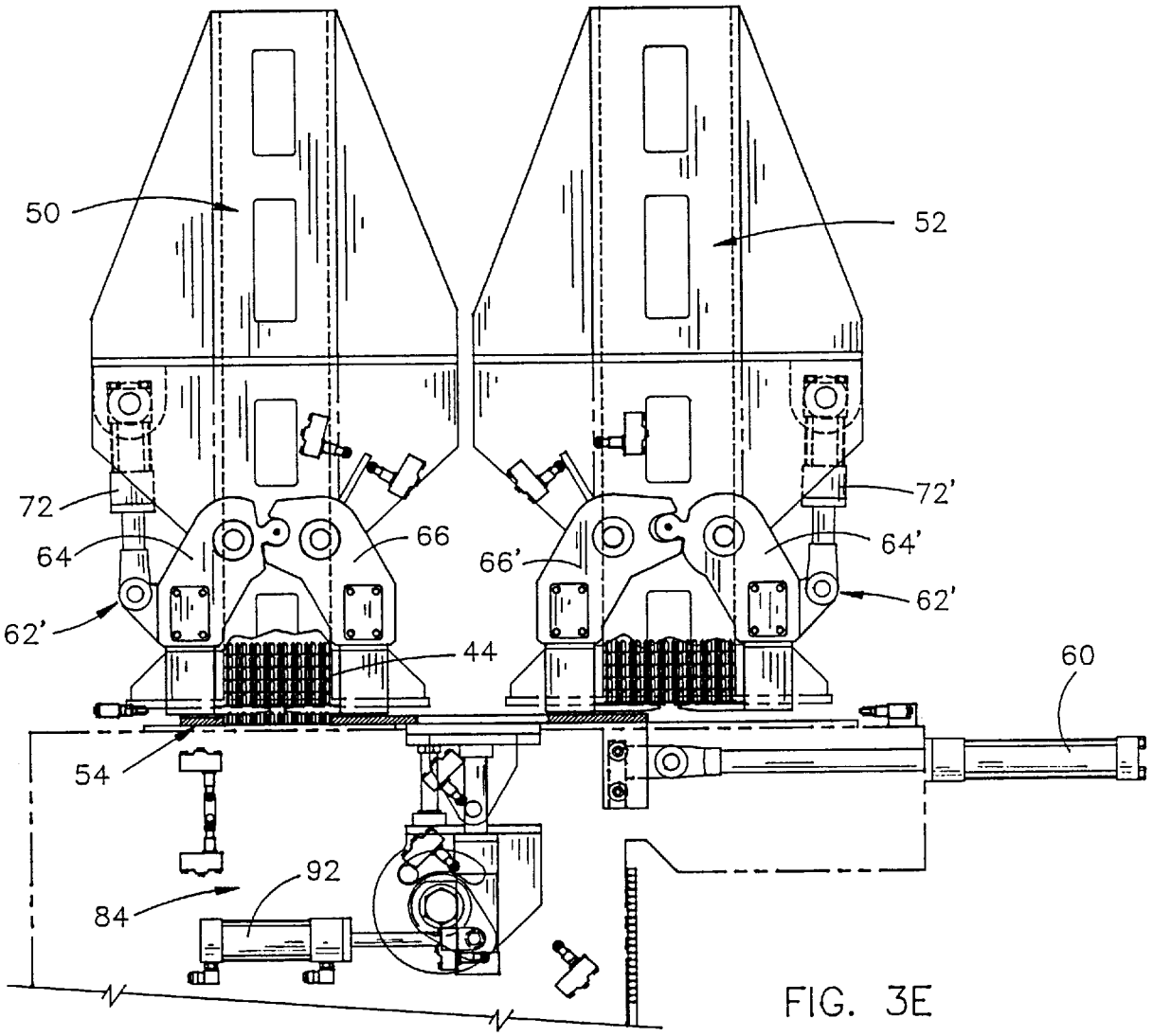
FIG. 3E is a view generally similar to FIG. 3C except that the shuttle plate is positioned so as to receive an end plate from the other end plate hopper.
Figure 3F:
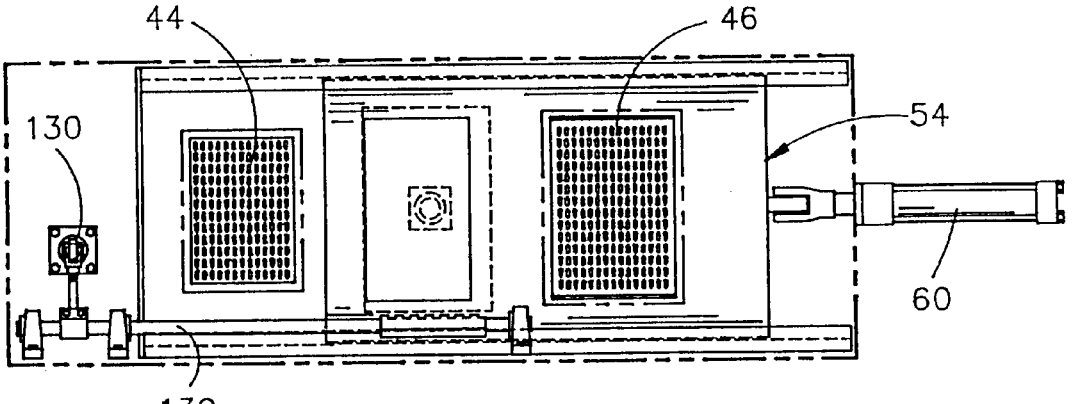
FIG. 3F is a horizontally sectional view showing the relationship of the plate hoppers and the shuttle plate with the shuttle plate opening being positioned beneath the hopper having the larger end plates therein.
Figure 6F:
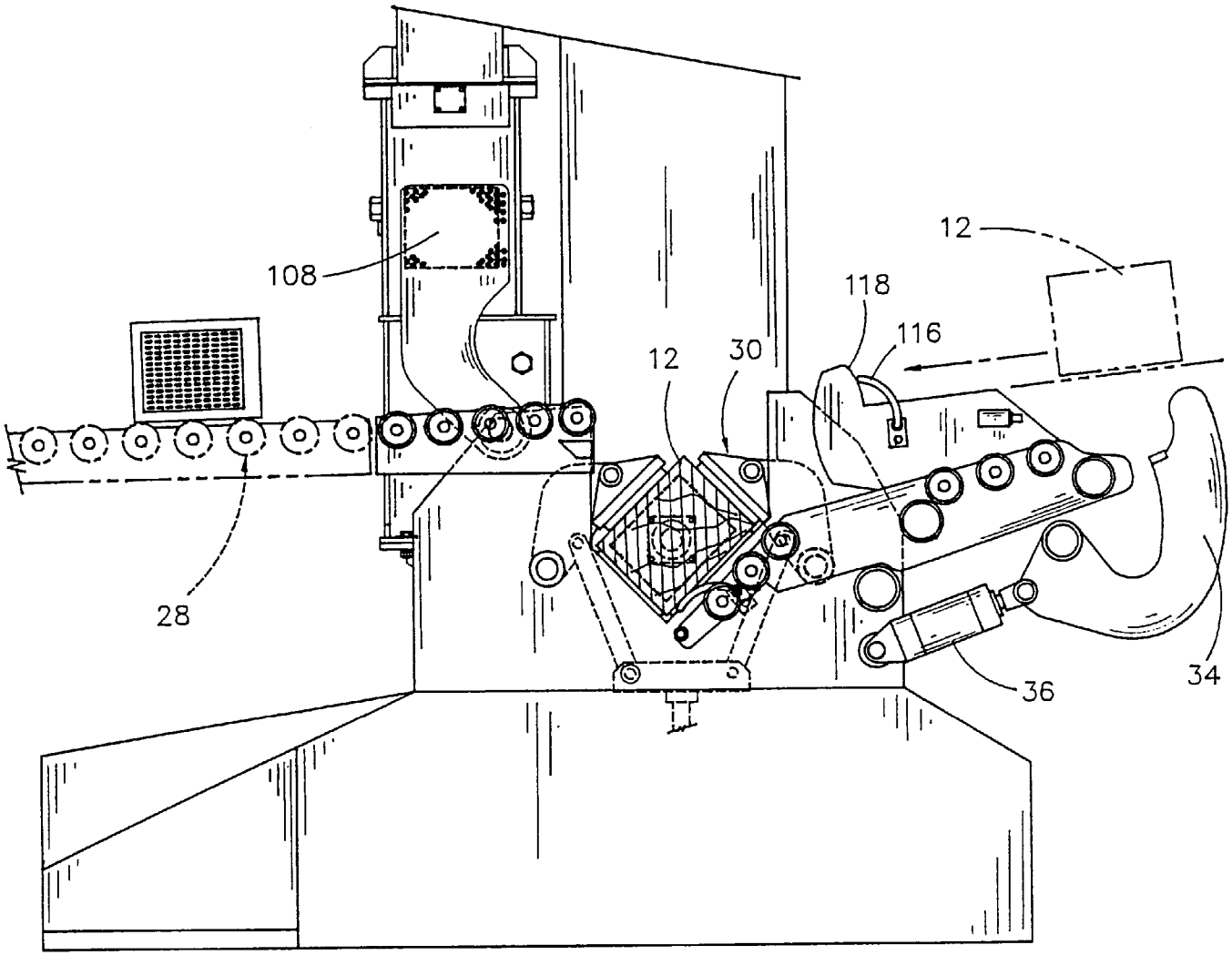
FIG. 6F is a view similar to FIG. 6E except that the tie clamping means is shown as clamping the end of the tie.
Figure 7:
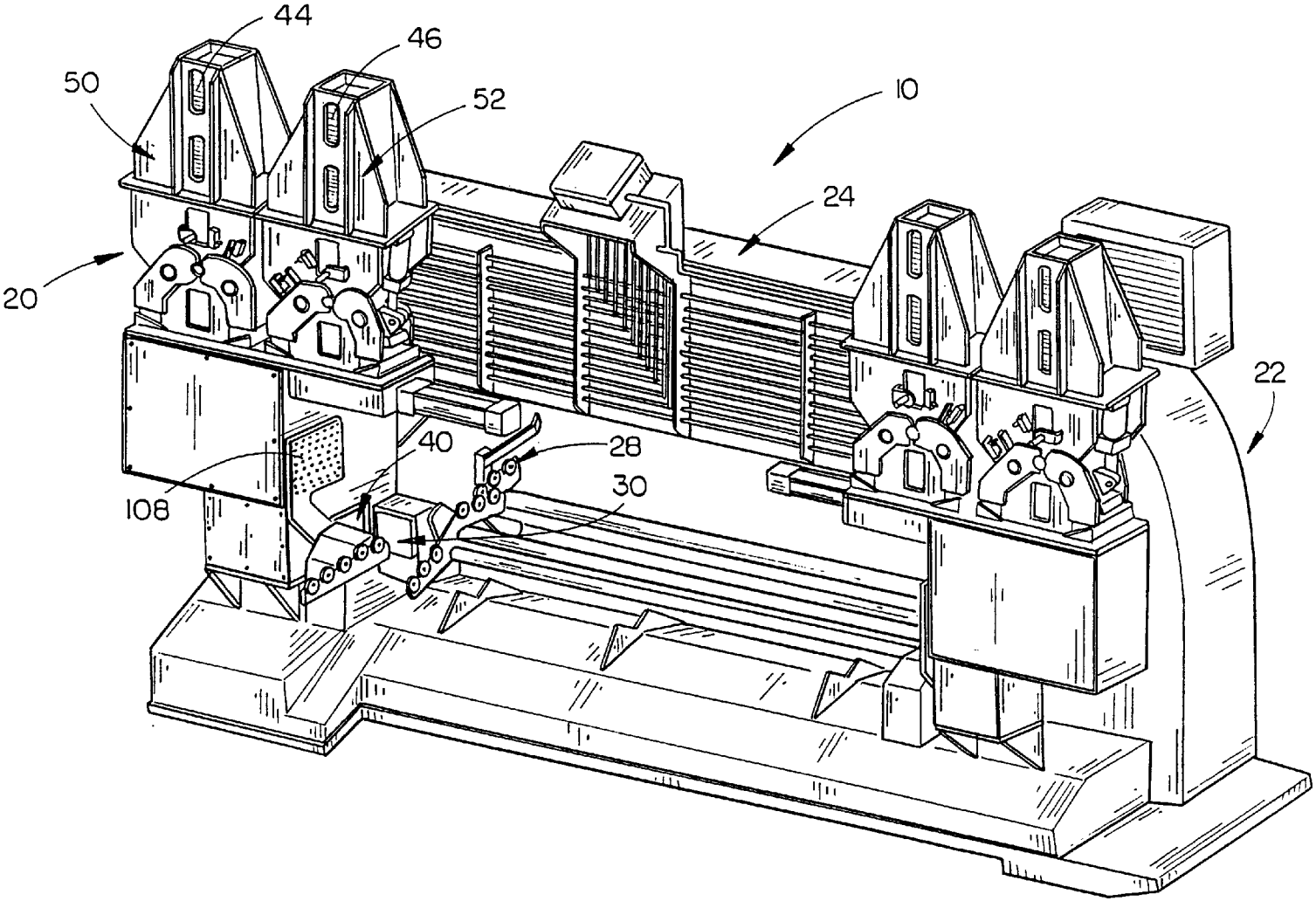
FIG. 7 is a perspective view of the end plating machine of this invention as viewed from the out-feed side of the machine.
Figure 8:
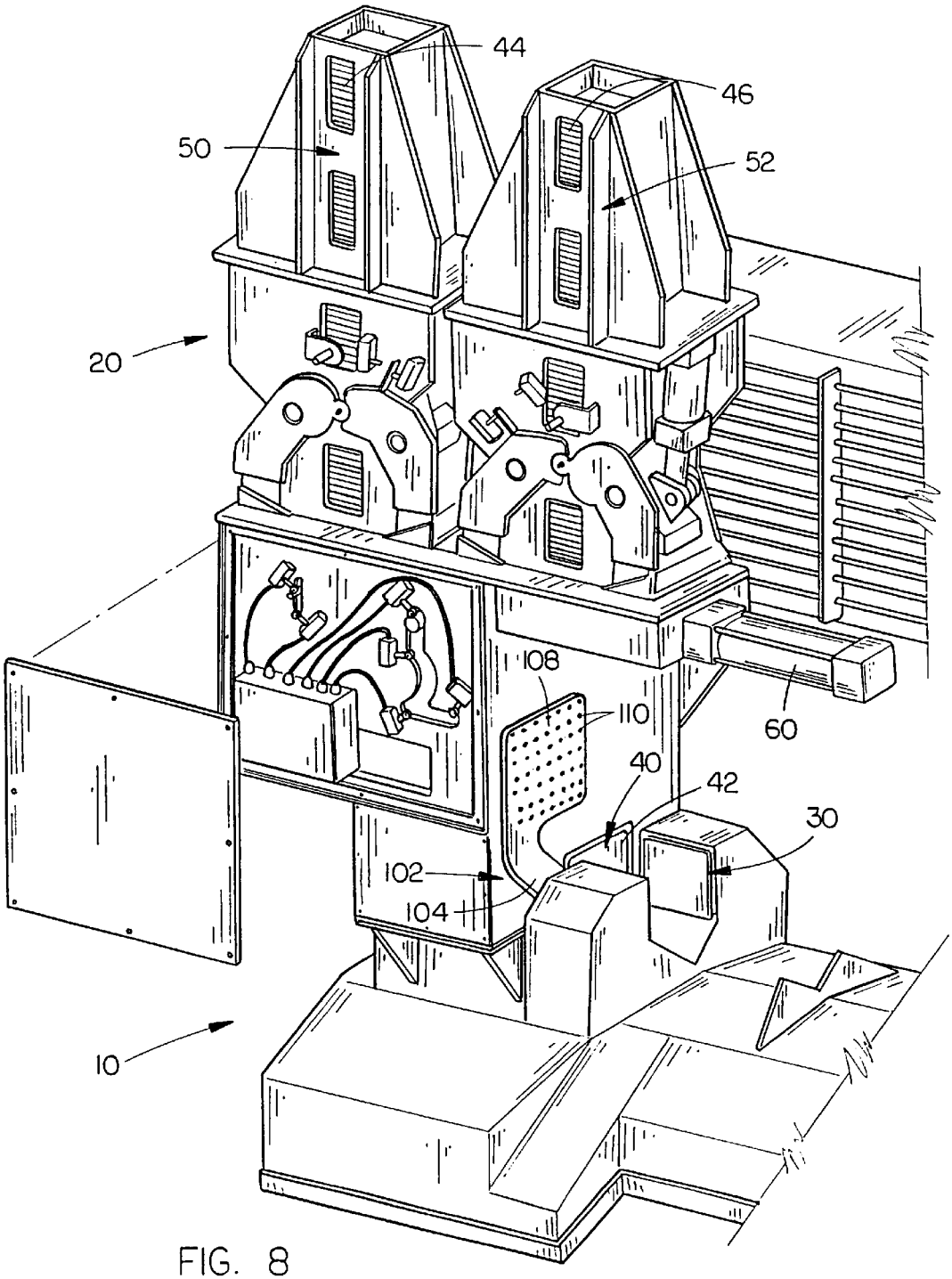
FIG. 8 is a partial perspective view of one end frame of the machine with a cover thereon having been removed therefrom to more fully illustrate the invention.
Figure 9:
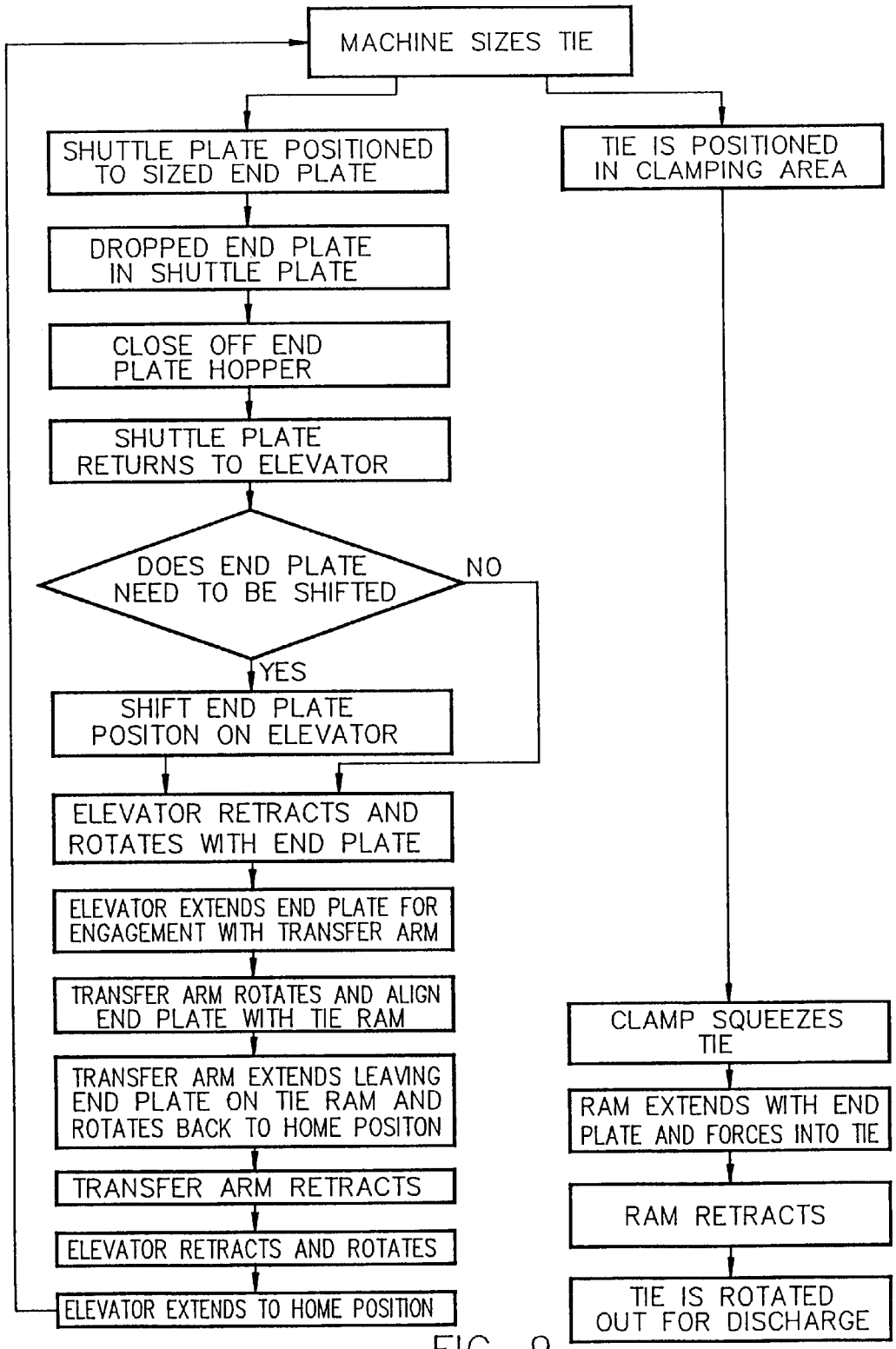
FIG. 9 is a schematic of the sequence of operation of the machine.

Once the thickness of the tie 12 has been sensed, the machine moves the tie from the position illustrated in FIG. 6B into the position illustrated in FIG. 6F. At that time, the tie clamping apparatus 30 and the clamping apparatus 32 will squeeze or clamp the ends of the tie to close any splits or cracks therein. Inasmuch as the end plating operation at each end of the tie is identical, only the end plating operation at one end of the tie will be described in detail. Assuming that a larger tie has been sensed by the tie sensing arm 34, the shuttle plate 54 is moved to the position illustrated in FIG. 4C so that the opening 58 in end plate 54 is positioned directly below the stack of end plates 46 in hopper 52. In this position, the fingers 80' and 82' are initially positioned beneath the lowermost end plate 46 in hopper 52. The arms 64' and 66' are then pivotally moved from the position of FIG. 4C to the position of FIG. 3B so that the stack of end plates moves downwardly in hopper 52 which results in the lowermost end plate 46 being positioned in the opening 58 in shuttle plate 54. The arms 64' and 66' are then pivotally moved from the position of FIG. 3B to the position of FIG. 3C which causes the end plates 46, above the lowermost end plate 46, to be raised with respect to the lowermost end plate 46 so that the lowermost end plate 46 is separated from the end plates thereabove. During this time, the plate elevator 84 is in the position illustrated in FIG. 3B so that the magnetic elevator plate 98 is facing upwardly as seen in FIG. 3E. The hydraulic cylinder 60 is then actuated which causes the shuttle plate 54 to be moved from the position of FIG. 3C to the position of FIG. 3D which results in the end plate 46 coming into contact with the magnetic elevator plate 98 and to be magnetically connected thereto.

If the machine had sensed that a smaller tie was being introduced into the machine, the shuttle plate 54 would have been initially moved into the position illustrated in FIG. 3D so that opening 56 in shuttle plate 54 was positioned directly below the end plates 44 in hopper 50. The arms 64 and 66 would then have been pivotally moved outwardly from the position of FIG. 3D to permit the lowermost plate 44 in the stack of plates in hopper 50 to move into the opening 56 in shuttle plate 54. The arms 64 and 66 would then be pivotally moved towards one another so that the fingers 80 and 82 would pass between the lowermost plate 44 and the remaining plates in the stack of plates in hopper 50. The shuttle plate 54 would then be moved from the position of FIG. 3E to a position wherein plate 44 is able to come into contact with the magnetic elevator head 98.

Figure 3G:
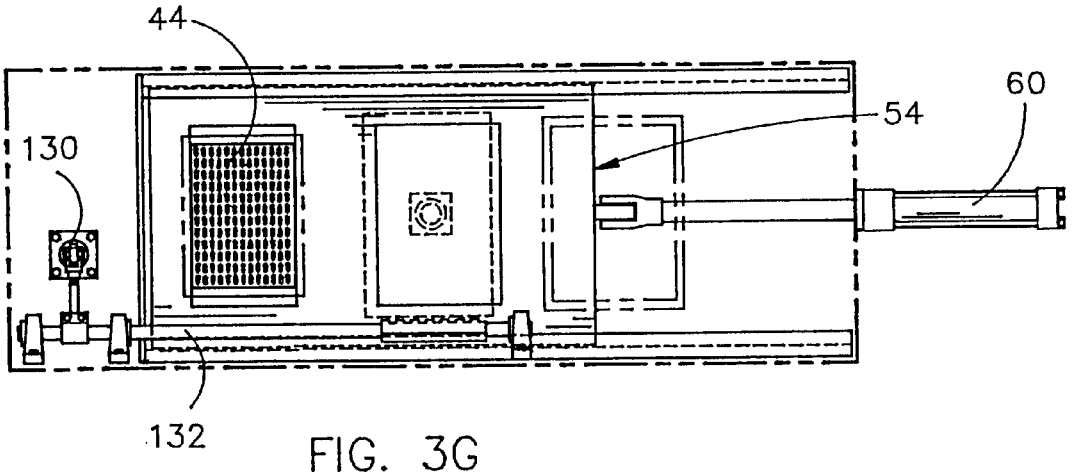
FIG. 3G is a view similar to FIG. 3F except that the shuttle plate opening is positioned beneath the hopper having the smaller end plates therein.
Figure 3H:
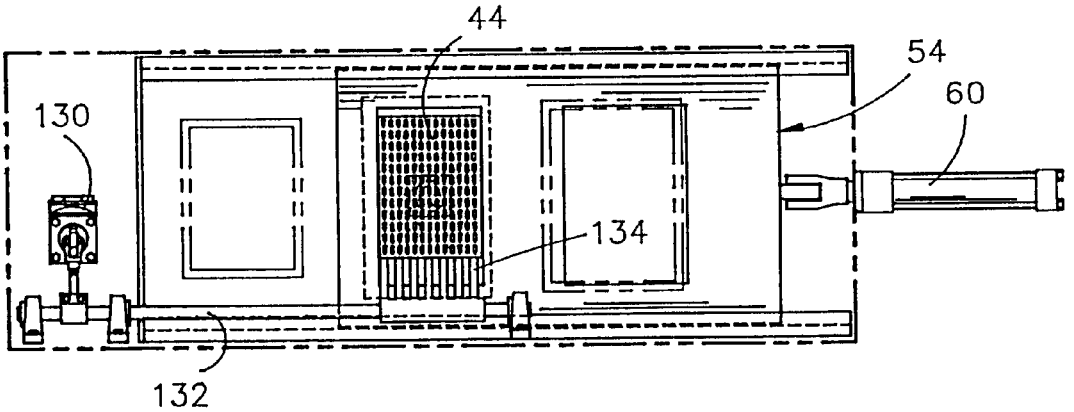
FIG. 3H is a view similar to FIG. 3G except that the shuttle plate opening and end plate therein, has been moved from the position of FIG. 3G to a position over the plate elevator and which illustrates the plate position adjuster being activated.

Assuming that a plate 44 has been delivered to the magnetic elevator head 98, an adjustment must be made of the position of the plate 44 thereon since a smaller tie has been sensed. The circuitry of the machine, after having sensed a smaller tie 12, and after having delivered a smaller plate 44 to the magnetic elevator head 98, causes the activation or retraction of cylinder 130 which rotates shaft 132 from the position of FIG. 3G to the position of FIG. 3H. The rotation of shaft 132 to the position of FIG. 3H causes the fingers 134 on shaft 132 to engage plate 44 (FIG. 3H) to shift or move plate 44 on elevator head 98 so that plate 44 will be properly positioned on elevator head 98 corresponding to the smaller tie 12 which is to be end plated.

Figure 4A:
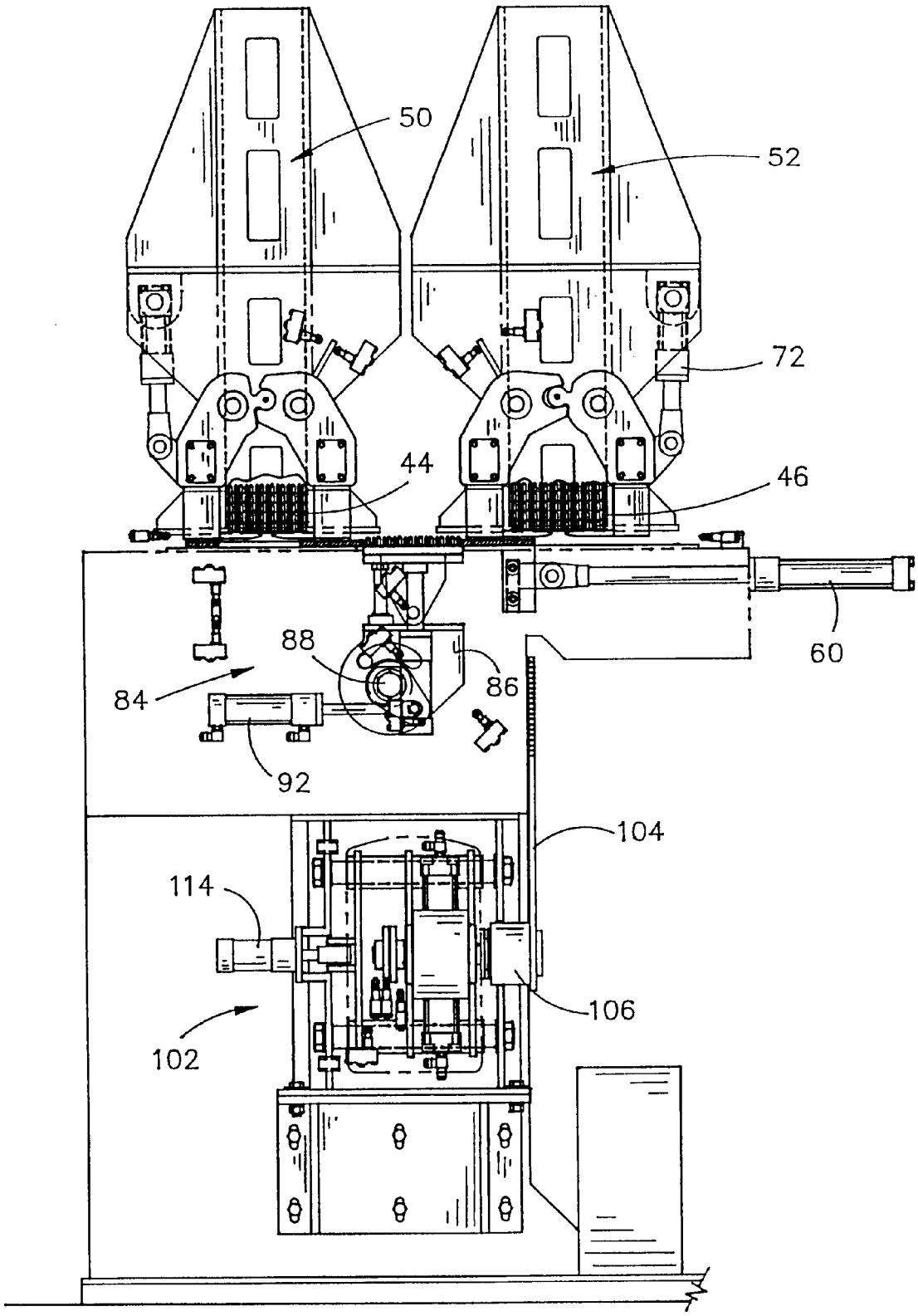
FIG. 4A is an end elevational view of one of the end frames, with portions thereof cut-away showing the plate elevator receiving one of the smaller end plates.
Figure 4B:
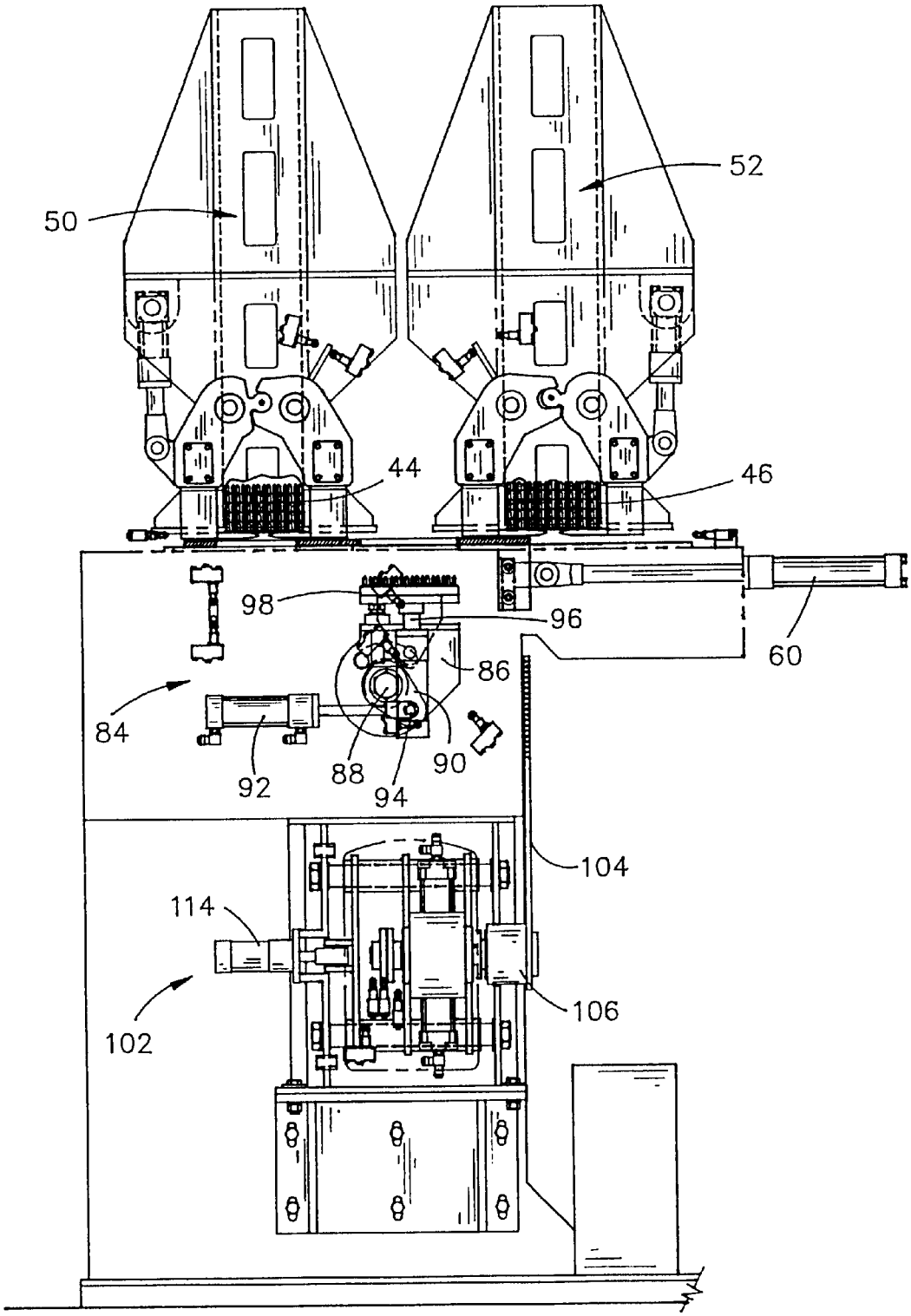
FIG. 4B is a view similar to FIG. 4A except that the plate elevator has lowered the end plate from the position of FIG. 4A.
Figure 4C:
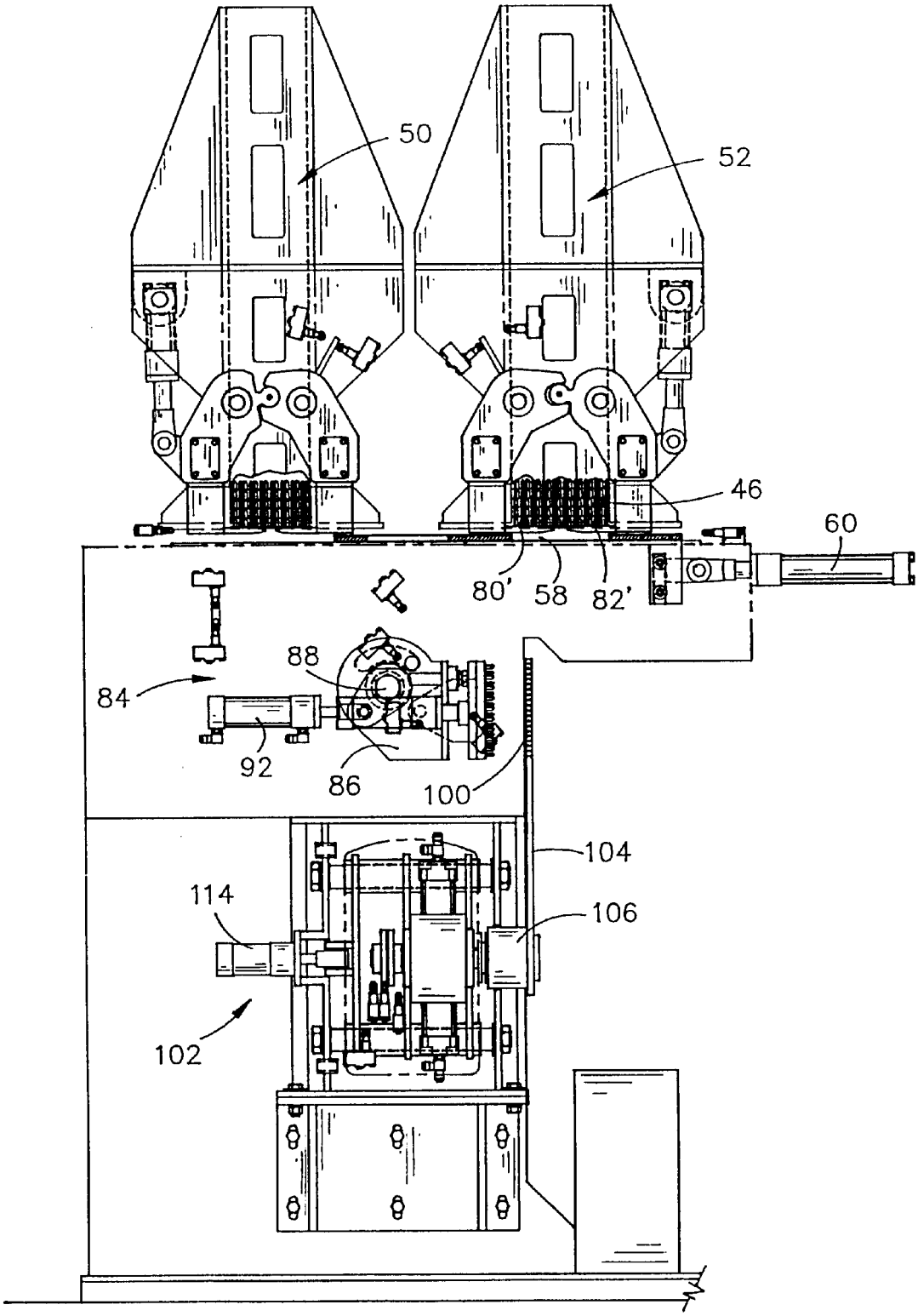
FIG. 4C is a view similar to FIGS. 4A and 4B with the plate elevator having rotated the end plate into a vertically disposed position.
Figure 4D:
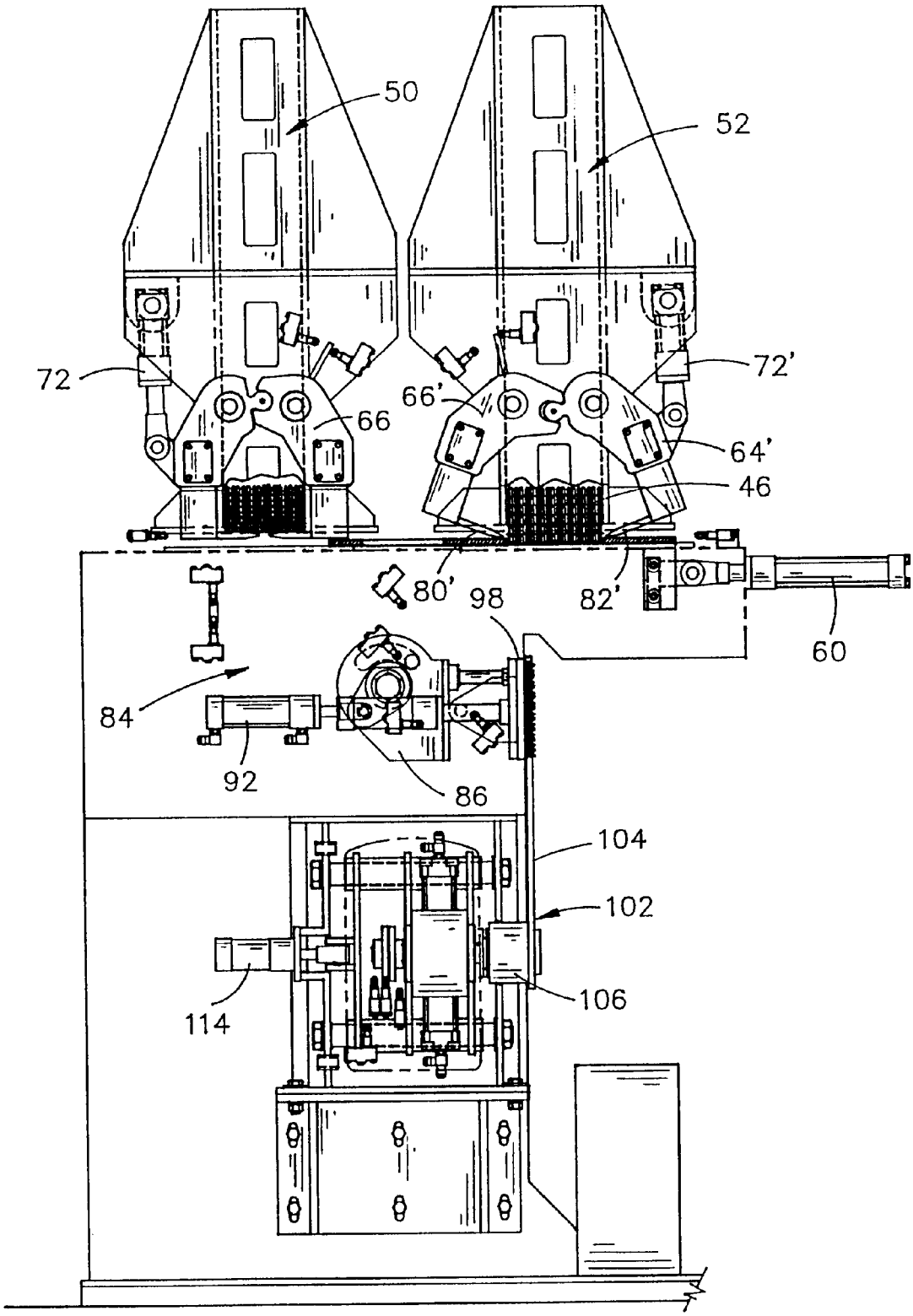
FIG. 4D is a view similar to FIG. 4C except that the plate elevator has moved the end plate laterally into engagement with the transporter arm.
Figure 5A:
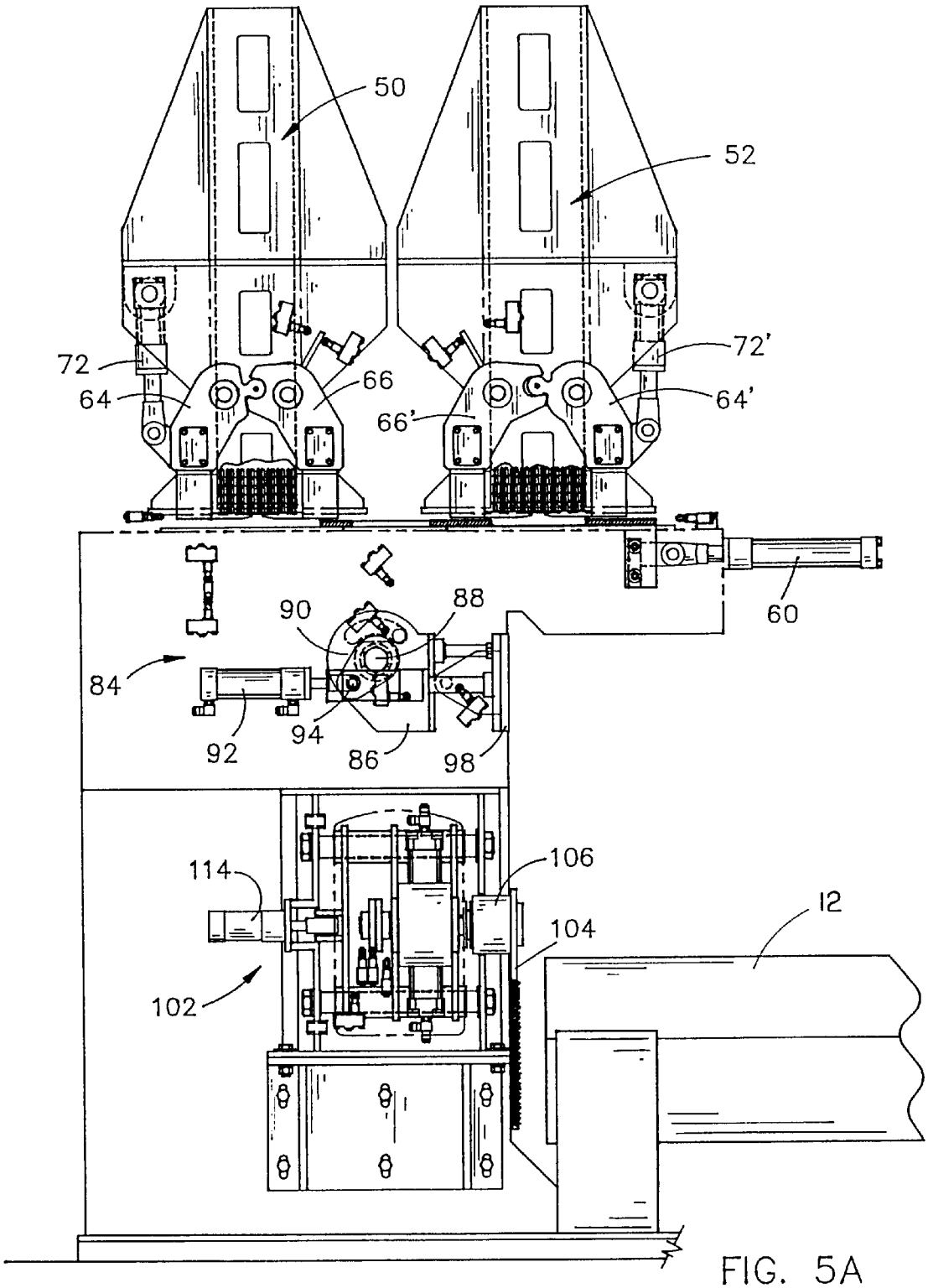
FIG. 5A is a view similar to FIG. 4D except that the transporter arm has moved the end plate into position in front of the power ram.
Figure 5B:
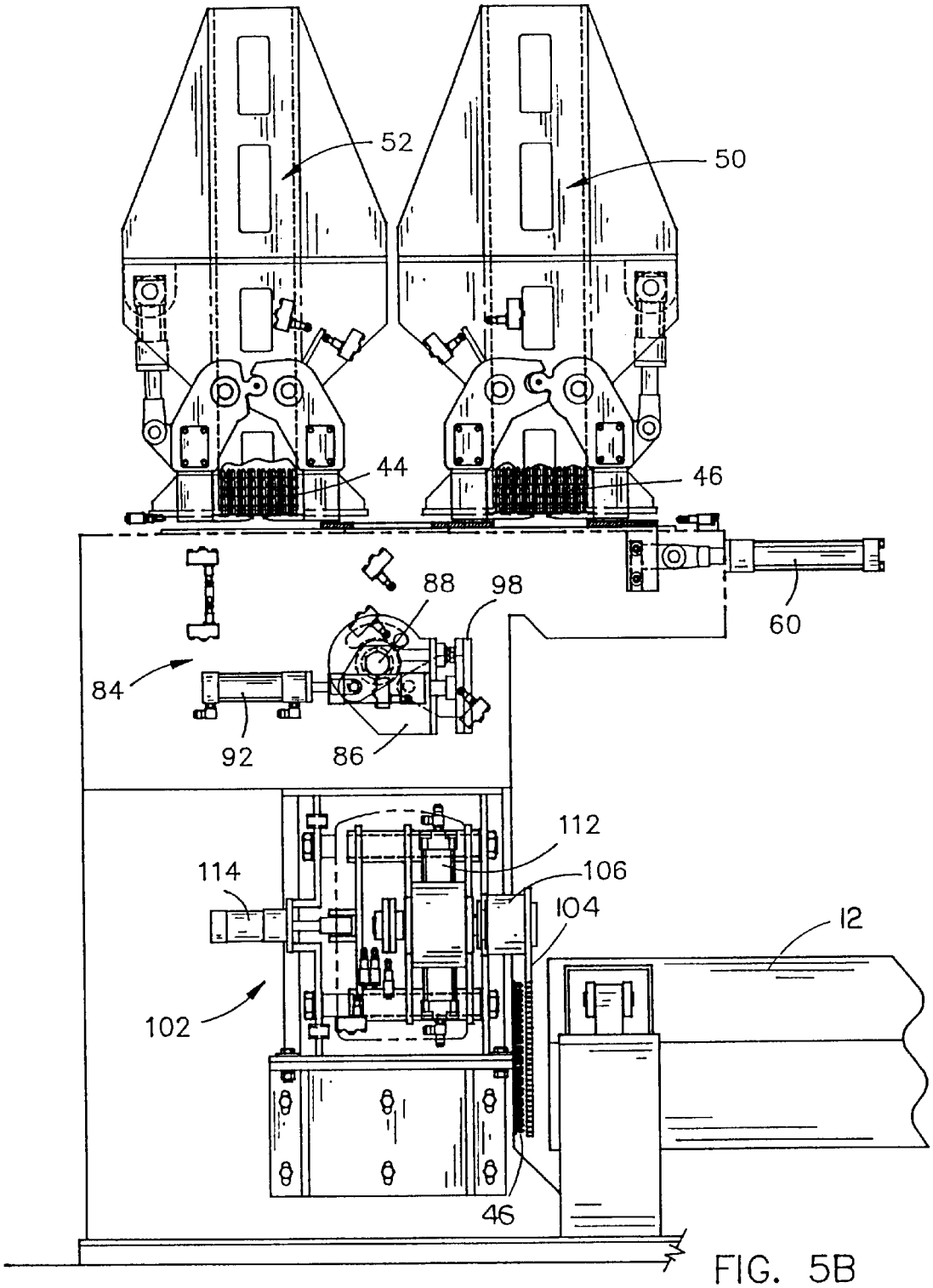
FIG. 5B is a view similar to FIG. 5A except that the transporter arm has been moved laterally with respect to the end plate which is magnetically positioned on the power ram.
Figure 5C:
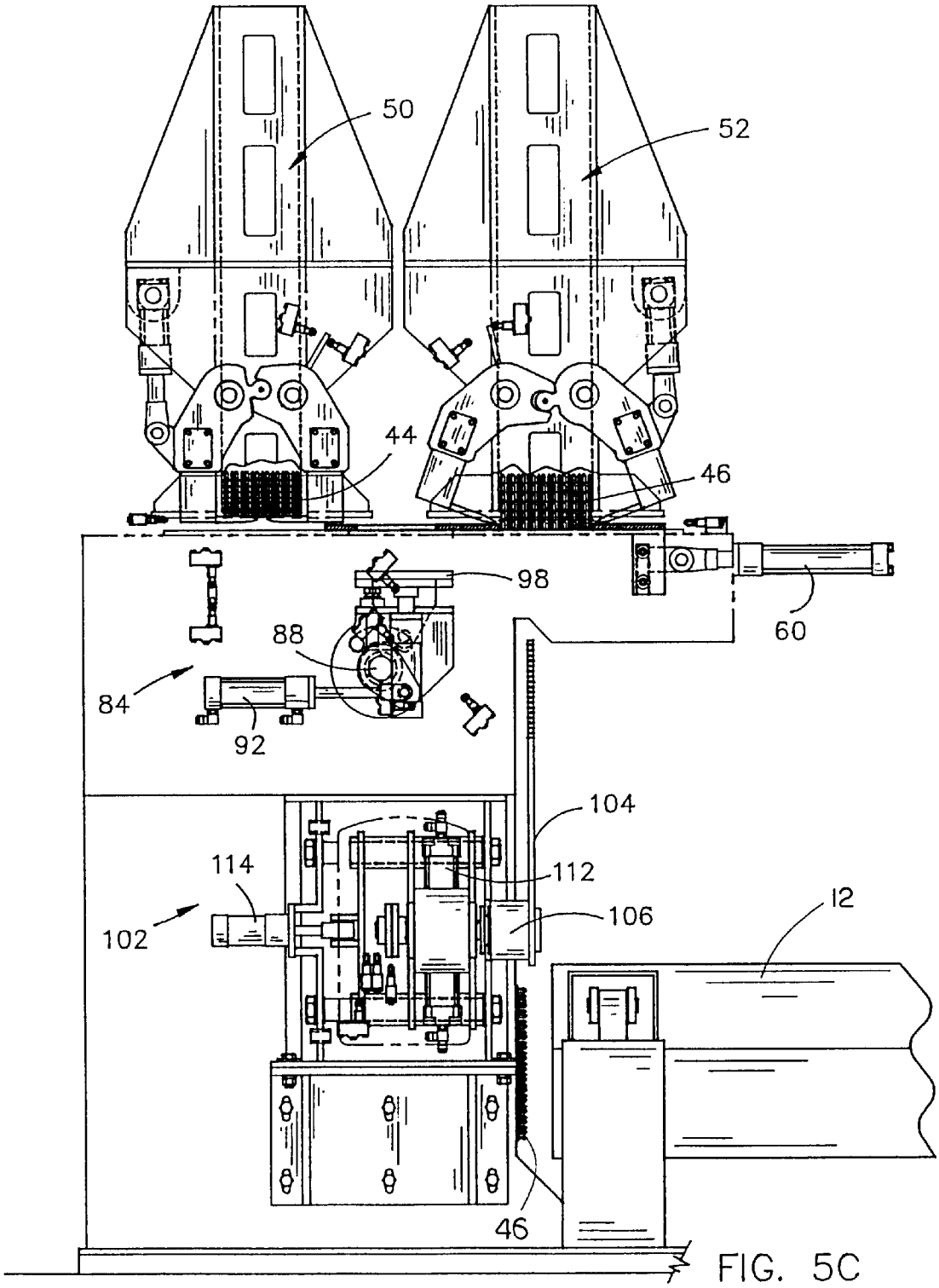
FIG. 5C is a view similar to FIG. 5B except that the transporter arm has been pivotally moved upwardly from the position of FIG. 5B and the shuttle plate is receiving another end plate.
Figure 5D:
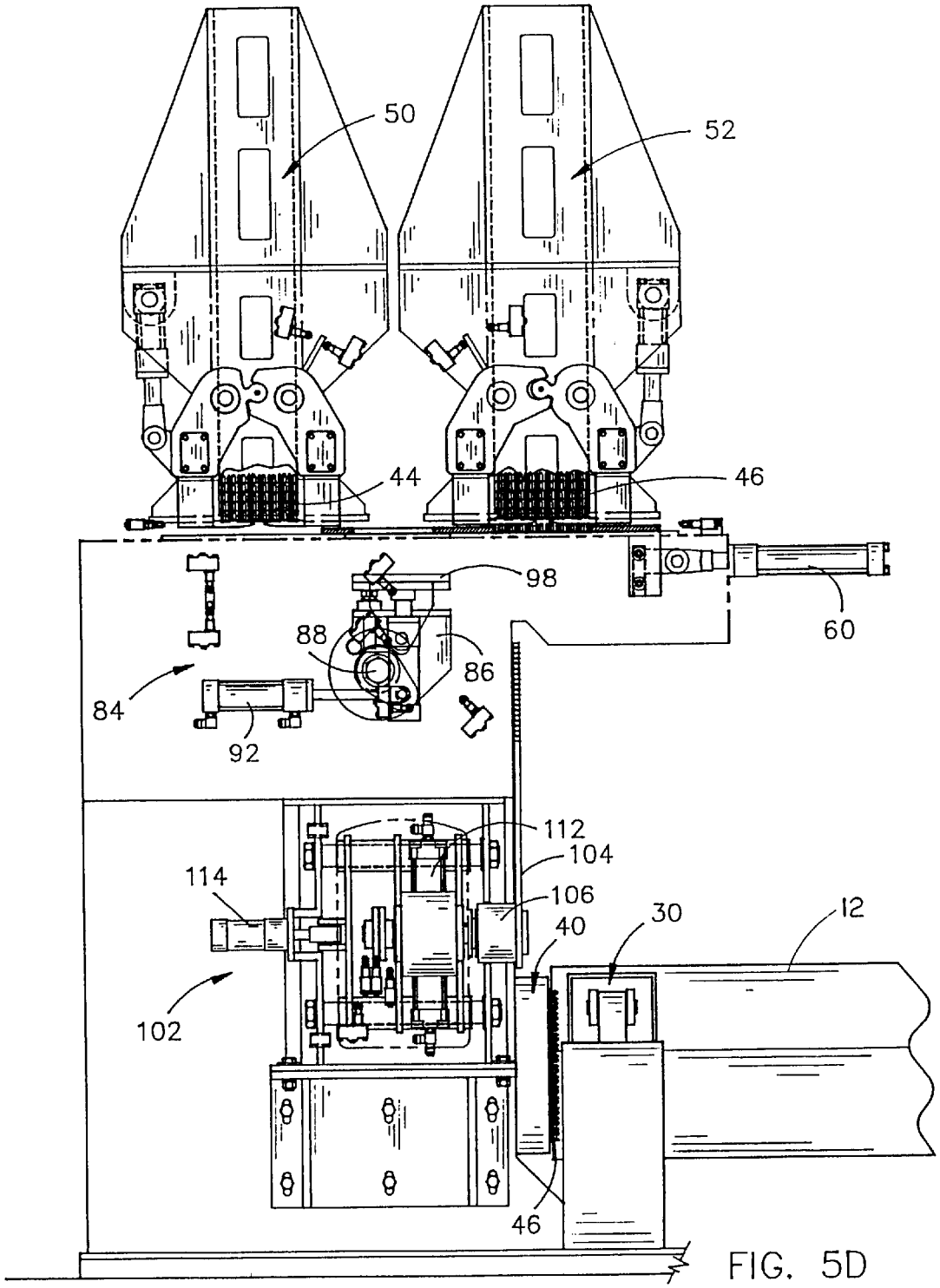
FIG. 5D is a view similar to FIG. 5C except that the power ram is shown as having driven the end plate into the end of the tie.

Assuming that a plate 46 has been delivered to the magnetic elevator head 98, the hydraulic cylinder 96 is then retracted so that the elevator head 98 moves from the position of FIG. 4A to the position of FIG. 4B. After the elevator head 98 and the plate 46 thereon has been moved to the position illustrated in FIG. 4B, hydraulic cylinder 92 is retracted so that the frame 86 is pivoted from the position of FIG. 4B to the position of FIG. 4C to align end plate 46 with the opening 100 and to align end plate 46 with the plate holding portion 108 of transfer arm 104 which is positioned outwardly of opening 100. Hydraulic cylinder 96 is then extended so that the magnetic elevator head 98 and the plate 46 thereon are moved from the position of FIG. 4C to the position illustrated in FIG. 4D. In the position of FIG. 4D, the teeth of the end plate 46 engage the openings 110 in the plate holding portion 108 of the transfer arm 104 to positively connect the plate 46 to the arm 104. Transfer arm 104 is then pivotally moved from the position of FIG. 4D to the position of FIG. 5A by the hydraulic cylinder 112. The rotational movement of the transfer arm 104 from the position of FIG. 4D to the position of FIG. 5A causes the plate 44 to magnetically disengage from the magnetic elevator head 98. When the transfer arm 104 and the plate 46 have been pivotally moved to the position of FIG. 5A, the plate 46 is magnetically connected to the magnetic head 42 of the power ram 40. Transfer arm 104 is then laterally moved from the position of FIG. 5A to the position of FIG. 5B by the hydraulic cylinder 114 to cause the transfer arm 104 to disengage from the plate 104 which is maintained in position on the magnetic head 42 of the power ram 40. The transfer arm 104 is then rotated from the position of FIG. 5B to the position of FIG. 5C. At that time, hydraulic cylinder 114 is retracted to cause the transfer arm 104 to move from the position of FIG. 5C to the position of FIG. 5D. At that time, or simultaneously therewith, the power ram 40 is moved outwardly towards the end of the tie 12 to drive the plate 46 into the end of the tie which is being clamped or squeezed by the tie clamping mechanism 30.

It should be noted that while the sequence above is occurring, the identical sequence is occurring at the opposite end of the tie. Further, it should be noted that while the transfer arms 104 and 104' are positioning the plates and the power rams are driving the plates into the ends of the tie, the next tie would have already been sensed and the plate transfer process commenced. After end plating, the tie is released from the clamping apparatuses 30 and 32 and moved out of the machine.

Figure 10:
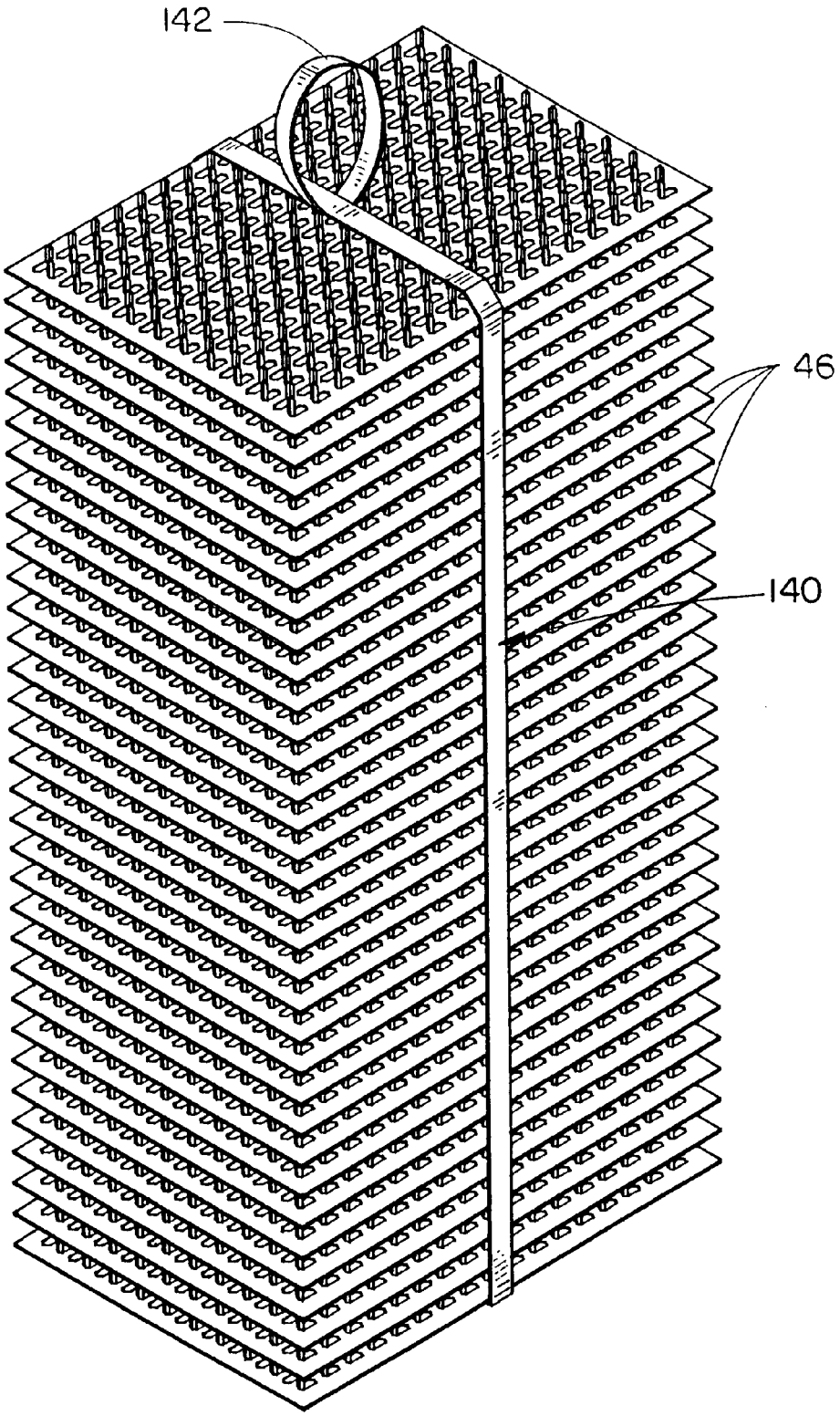
FIG. 10 is a perspective view of a stack of end plates illustrating the manner in which the end plates are secured together for insertion into one of the end plate hoppers on the machine.

FIG. 10 illustrates what is believed to be a novel method of bundling a stack of end plates to enable the same to be easily handled and to be inserted into one of the end plate hoppers on the machine. A plurality of end plates 46 (or plate 44 if the smaller plates are being handled) are stacked one upon the other as seen in FIG. 10 so that the teeth thereof extend upwardly. A flexible strap 140 is placed around the stack of end plates 46 to maintain the end plates 46 in the stacked condition. Handle or loop 142 is provided on the strap 140 as seen in FIG. 10. The entire stack may then be lifted by the handle 142 and placed in the proper hopper 50, 50', 52 or 52' in the machine 10. Once the stack is in the hopper, the strap 140 may be cut and removed from the stack.

Thus it can be seen that a novel end plating machine has been provided which end plates a tie without the need for initially hand tacking the end plates onto the ends of the tie. Further, it can be seen that a novel end plating machine has been provided which enables ties of different dimensions to be automatically end plated.

Thus, it can been seen that the invention accomplishes at least all of its stated objectives.

I claim:

1. An end plating machine for a wood tie having opposite ends, comprising:

a frame means including horizontally spaced-apart first and second end frames;

said frame means having tie in-feed and out-feed portions;

means for positioning a tie between said end frames;

at least a first tie clamping means adjacent said first end frame for clamping one end of a tie positioned between said end frames;

a first horizontally disposed, power ram means associated with said first end frame for driving an end plate into said one end of the tie while said first tie clamping means is clamping the one end of the tie positioned therein;

a first end plate station on said first end frame for supporting a plurality of end plates;

a first end plate transporter on said first end frame for successively transporting individual end plates from said first end plate station to a position adjacent said one end of the tie positioned in said first tie clamping means so that said first power ram means may drive the end plate into the said one end of the tie.

2. The end plating machine of claim 1 including a tie feeding conveyor at said in-feed portion for successively conveying ties to said first tie clamping means.

3. The end plating machine of claim 1 wherein the end plates are stacked one upon the other in said first end plate station.

4. The end plating machine of claim 1 wherein said first end plate station comprises first and second end plate hoppers, respectively, wherein said end plates are stacked one upon another therein.

5. The end plating machine of claim 4 wherein said first end frame includes means for separating the lowermost end plate in the associated hopper from the end plates thereabove.

6. The end plating machine of claim 1 wherein a second end plate station is positioned on said first end frame for supporting end plates having a different dimension than that supported by said first end plate station.

7. An end plating machine for a wood tie having opposite ends, comprising:

a frame means including horizontally spaced-apart first and second end frames;

said frame means having tie in-feed and out-feed portions;

means for positioning a tie between said end frames;

at least a first tie clamping means adjacent said first end frame for clamping one end of a tie positioned between said end frames;

a first horizontally disposed, power ram means associated with said first end frame for driving an end plate into said one end of the tie while said first tie clamping means is clamping the one end of the tie positioned therein;

a first end plate station on said first end frame for supporting a plurality of end plates;

a first end plate transporter on said first end frame for successively transporting individual end plates from said first end plate station to a position adjacent said one end of the tie positioned in said first tie clamping means so that said first power ram means may drive the end plate into the said one end of the tie;

a second end plate station positioned on said first end frame for supporting end plates having a different dimension than that supported by said first end plate station;

a sensing means for sensing ties of different dimensions;

and means for controlling the operation of said end plate transporter so that the properly dimensioned end plate will be delivered to said power ram means.

* * * * *